US008818000B2

(12) United States Patent
Andrea

(10) Patent No.: US 8,818,000 B2
(45) Date of Patent: Aug. 26, 2014

(54) SYSTEM, DEVICE, AND METHOD UTILIZING AN INTEGRATED STEREO ARRAY MICROPHONE

(75) Inventor: Douglas Andrea, Sag Harbor, NY (US)

(73) Assignee: Andrea Electronics Corporation, Bohemia, NY (US)

( * ) Notice: Subject to any disclaimer, the term of this patent is extended or adjusted under 35 U.S.C. 154(b) by 547 days.

(21) Appl. No.: 12/916,470

(22) Filed: Oct. 29, 2010

(65) Prior Publication Data

US 2011/0129097 A1 Jun. 2, 2011

Related U.S. Application Data

(63) Continuation-in-part of application No. 12/429,623, filed on Apr. 24, 2009.

(60) Provisional application No. 61/048,142, filed on Apr. 25, 2008.

(51) Int. Cl.
*H04R 1/10* (2006.01)

(52) U.S. Cl.
USPC ..... 381/74; 381/92; 381/94.1; 381/71.1; 381/97

(58) Field of Classification Search
USPC ..... 381/26, 91, 92, 72, 74, 119, 120, 122, 381/309, 311, 23.1, 313, 317, 318, 320, 381/321, 322, 324, 327, 328, 329, 330, 381/71.1, 71.2, 71.6, 71.7, 71.8, 71.11, 381/71.12, 66, 79, 89, 332, 93, 94.1, 94.7, 381/94.8, 94.9, 95, 17, 98, 99, 100, 101, 381/102, 103, 121, 97; 455/569.1, 563, 455/575.2, 575.6, 90.3; 379/406.01–406.16
See application file for complete search history.

(56) References Cited

U.S. PATENT DOCUMENTS

| | | | | |
|---|---|---|---|---|
| 4,088,849 | A * | 5/1978 | Usami et al. | 379/430 |
| 5,815,582 | A | 9/1998 | Claybaugh et al. | |
| 5,825,897 | A * | 10/1998 | Andrea et al. | 381/71.6 |
| 7,065,219 | B1 * | 6/2006 | Abe et al. | 381/74 |
| 7,092,529 | B2 | 8/2006 | Yu et al. | |
| 2006/0182287 | A1 * | 8/2006 | Schulein et al. | 381/74 |
| 2006/0270468 | A1 | 11/2006 | Hui et al. | |
| 2008/0175408 | A1 * | 7/2008 | Mukund et al. | 381/94.1 |

* cited by examiner

*Primary Examiner* — Leshui Zhang
(74) *Attorney, Agent, or Firm* — Vedder Price P.C.; Thomas J. Kowalski; Rebecca G. Rudich

(57) ABSTRACT

The invention relates to an audio device for use proximate a user's ears. The audio device includes first and second audio transmitting/receiving devices that are capable of operating in stereo. The audio device may be used within a system for manipulating audio signals received by the device. The manipulation may include processing received audio signals to enhance their quality. The processing may include applying one or more audio enhancement algorithms such as beamforming, active noise reduction, etc. A corresponding method for manipulating audio signals is also disclosed.

16 Claims, 34 Drawing Sheets

SYSTEM, DEVICE, AND METHOD UTILIZING AN INTEGRATED STEREO ARRAY MICROPHONE

CROSS-REFERENCE TO RELATED APPLICATIONS

The instant APPLICATION is a continuation-in-part of U.S. patent application Ser. No. 12/429,623, entitled HEADSET WITH INTEGRATED STEREO ARRAY MICROPHONE, filed Apr. 24, 2009, the entire disclosure of which is hereby incorporated by reference. U.S. patent application Ser. No. 12/429,623 claims the benefit of Provisional Application No. 61/048,142 filed Apr. 25, 2008. U.S. patent application Ser. No. 12/429,623 also makes reference to U.S. patent application Ser. No. 12/332,959 filed on Dec. 11, 2008, which claims benefit Provisional Application No. 61/012,884. All of the above-mentioned patent applications are incorporated herein by reference in their entirety as if fully set forth herein.

Reference is also made to U.S. Pat. Nos. 5,251,263, 5,381,473, 5,673,325, 5,715,321, 5,732,143, 5,825,897, 5,825,898, 5,909,495, 6,009,519, 6,049,607, 6,061,456, 6,108,415, 6,178,248, 6,198,693, 6,332,028, 6,363,345, 6,377,637, 6,483,923, 6,594,367, 7,319,762, D371,133, D377,023, D377,024, D381,980, D392,290, D404,734, D409,621 and U.S. patent application Ser. No. 12/265,383. All of these patents and patent applications are incorporated herein by reference.

The foregoing applications, and all documents cited therein or during their prosecution ("appln cited documents") and all documents cited or referenced in the appln cited documents, and all documents cited or referenced herein ("herein cited documents"), and all documents cited or referenced in herein cited documents, together with any manufacturer's instructions, descriptions, product specifications, and product sheets for any products mentioned herein or in any document incorporated by reference herein, are hereby incorporated herein by reference, and may be employed in the practice of the invention.

FIELD OF THE INVENTION

The invention generally relates to audio transmitting/receiving devices such as headsets with microphones, earbuds with microphones, and particularly relates to stereo headsets and earbuds with an integrated array of microphones. These devices may be used in a multitude of different applications including, but not limited to gaming, communications such as voice over internet protocol ("VoIP"), PC to PC communications, PC to telephone communications, speech recognition, recording applications such as voice recording, environmental recording, and/or surround sound recording, and/or listening applications such as listening to various media, functioning as a hearing aid, directional listening and/or active noise reduction applications.

BACKGROUND OF THE INVENTION

There is a proliferation of mainstream PC games that support voice communications. Team chat communication applications are used such as Ventrilo®. These communication applications are being used on networked computers, utilizing Voice over Internet Protocol (VOIP) technology. PC game players typically utilize PC headsets to communicate via the internet and the earphones help to immerse themselves in the game experience.

When gamers need to communicate with team partners or taunt their competitors, they typically use headsets with close talking boom microphones, for example as shown in FIG. 7. The boom microphone may have a noise cancellation microphone, so their voice is heard clearly and any annoying background noise is cancelled. In order for these types of microphones to operate properly, they need to be placed approximately one inch in front of the user's lips.

Gamers are, however, known to play for many hours without getting up from their computer terminal. During prolonged game sessions, the gamers like to eat and drink while playing for these long periods of time. If the gamer is not communicating via VoIP, he may move the boom microphone with his hand into an upright position to move it away from in front of his face. If the gamer wants to eat or drink, he would also need to use one hand to move the close talking microphone from in front of his mouth. Therefore if the gamer wants to be unencumbered from constantly moving the annoying close talking boom microphone and not to take his hands away from the critical game control devices, an alternative microphone solution would be desirable.

Accordingly, there is a need for a high fidelity far field noise canceling microphone that possesses good background noise cancellation and that can be used in any type of noisy environment, especially in environments where a lot of music and speech may be present as background noise (as in a game arena or internet cafe), and a microphone that does not need the user to have to deal with positioning the microphone from time to time.

Citation or identification of any document in this application is not an admission that such document is available as prior art to the present invention.

SUMMARY OF THE INVENTION

An object of the present invention is to provide for a device that integrates both these features. A further object of the invention is to provide for a stereo headset or stereo earbuds with an integrated array of microphones utilizing an adaptive beam forming algorithm. This embodiment is a new type of "boom free" headset, which improves the performance, convenience and comfort of a game player's experience by integrating the above discussed features. Some embodiments may include stereo earbuds with integrated microphones. Various embodiments may include the use of stereo earbuds with integrated microphones without a boom microphone.

The present invention relates to an audio transmitting/receiving device; for example, stereo earbuds or a stereo headset with an integrated array of microphones utilizing an adaptive beam forming algorithm. The invention also relates to a method of using an adaptive beam forming algorithm that can be incorporated into a transmitting/receiving device such as a set of earbuds or a stereo headset. In some embodiments, a stereo audio transmitting/receiving device may incorporate the use of broadside stereo beamforming.

One embodiment of the present invention may be a noise canceling audio transmitting/receiving device which may comprise at least one audio outputting component, and at least one audio receiving component, wherein each of the receiving means may be directly mounted on a surface of a corresponding outputting means. The noise canceling audio transmitting/receiving device may be a stereo headset or a ear bud set. At least one audio outputting means may be a speaker, headphone, or an earphone, and at least one audio receiving means may be a microphone. The microphone may be a uni- or omni-directional electret microphone, or a microelectromechanical systems (MEMS) microphone. The noise canceling audio transmitting/receiving device may also include a connecting means to connect to a computing device or an external device, and the noise canceling audio transmitting/receiving device may be connected to the computing device or the external device via a stereo speaker/microphone input or Bluetooth® or a USB external sound card device. The position of at least one audio receiving means may be adjustable with respect to a user's mouth.

The present invention also relates to a system for manipulating audio signals, an audio device for use proximate a user's ears, and a method for manipulating audio signals.

In one example, a system for manipulating audio signals is disclosed. The system includes an audio transmitting/receiving device configured for use in close proximity to a user's ears. In one example, the audio transmitting/receiving device may comprise a headset, such as an on-ear headset. An on-ear headset differs from an over-the-ear headset in that the audio transmitting/receiving portions are designed to contact a user's ears without completely engulfing the user's ears (as is the case with over-the-ear headsets). In another example, the audio transmitting/receiving device may comprise a pair of earbuds. In this example, the audio transmitting/receiving portions are each a single earbud. Regardless, in either the on-ear headset embodiment or the earbud embodiment, the audio transmitting/receiving device includes first and second audio transmitting/receiving portions (e.g., a single earpiece in the on-ear headset embodiment or a single earbud in the earbud embodiment). Each audio transmitting/receiving portion includes a body configured to be positioned proximate an ear of a user, at least one audio receiving means (e.g., one or more microphones) positioned within the body, and at least one audio outputting means (e.g., one or more speakers) also positioned within the body. The audio receiving means of each portion of the device are configurable to receive an audio signal, such as a sound emanating from a sound source, and transmit the received signal for further manipulation. A connecting means, such as a pair of wires capable of carrying a received audio signal, are connected to each portion of the audio/transmitting receiving device. An external device, such as a sound card, adaptor, audio card, dongle, communications device, recording device, and/or computing device may be connected to the audio transmitting/receiving device by the connecting means. The external device is configurable to process the audio signals transmitted by each of the audio transmitting/receiving portions.

In one example, the external device includes a processing means, such as a microprocessor, microcontroller, digital signal processor, or combination thereof operating under the control of executable instructions stored in one or more suitable storage components (e.g., memory). In this example, the processor is operative to execute executable instructions causing the processor to perform several operations in response to receiving audio signals from the audio receiving means of the first and second portions of the audio transmitting/receiving device. In one example, the executable instructions cause the processor to transmit the received audio signals back to the audio outputting means such that the audio outputting means may generate a surround sound effect. In another example, the executable instructions cause the processor to apply an active noise reduction (ANR) algorithm to the received audio signals. In still another example, the executable instructions cause the processor to apply a beamforming algorithm, such as a broadside beamforming algorithm, to the received audio signals. In yet another example, the executable instructions cause the processor to apply a beamforming algorithm to the received audio signals, amplify the beamformed audio signals, and transmit the amplified beamformed audio signals back to the audio outputting means of the first and second portions for output.

The present disclosure also provides an audio device for use in proximity to a user's ears, such as the audio transmitting receiving device disclosed above with respect to the system. In this example, each of the audio transmitting/receiving devices (e.g., earbuds or earpieces) are configurable to operate in stereo. That is, in this example, the audio receiving means (of each audio transmitting/receiving device included in the overall audio device) are configurable to receive audio signals and transmit those received audio signals. In one example, a first body of the first audio transmitting/receiving device includes an elongated portion containing the audio receiving means. Further, in this example, the first body includes a projecting portion coupled to the elongated portion. The projecting portion may include audio outputting means and may be configurable for adaptive reception in a user's first ear. In this example, the audio device may also include a second body that substantially retains the design of the first body. Furthermore, in this example, the projecting portions of each body are of sufficient length to: (1) position the outputting means of each body proximate the ear canals of a user; (2) position the elongated portions of the bodies proximate a user's face; and (3) inhibit the elongated portions of the bodies from contacting the user's ears or face. In another example, the audio transmitting/receiving devices of the audio device are spaced apart along a straight line axis. This may be achieved, for example, by a user wearing the audio device.

A corresponding method for use with the disclosed system and/or audio device is also provided.

Accordingly, it is an object of the invention to not encompass within the invention any previously known product, process of making the product, or method of using the product such that Applicants reserve the right and hereby disclose a disclaimer of any previously known product, process, or method. It is further noted that the invention does not intend to encompass within the scope of the invention any product, process, or making of the product or method of using the product, which does not meet the written description and enablement requirements of the USPTO (35 U.S.C. §112, first paragraph) or the EPO (Article 83 of the EPC), such that Applicants reserve the right and hereby disclose a disclaimer of any previously described product, process of making the product, or method of using the product.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

These and other embodiments are disclosed or are obvious from and encompassed by, the following Detailed Description.

BRIEF DESCRIPTION OF THE SEVERAL VIEWS OF THE DRAWINGS

The accompanying drawings, which are included to provide a further understanding of the invention, are incorporated in and constitute a part of this specification. The drawings presented herein illustrate different embodiments of the invention and together with the description serve to explain the principles of the invention. In the drawings.

DETAILED DESCRIPTION OF THE PREFERRED EMBODIMENT

Figure 1:
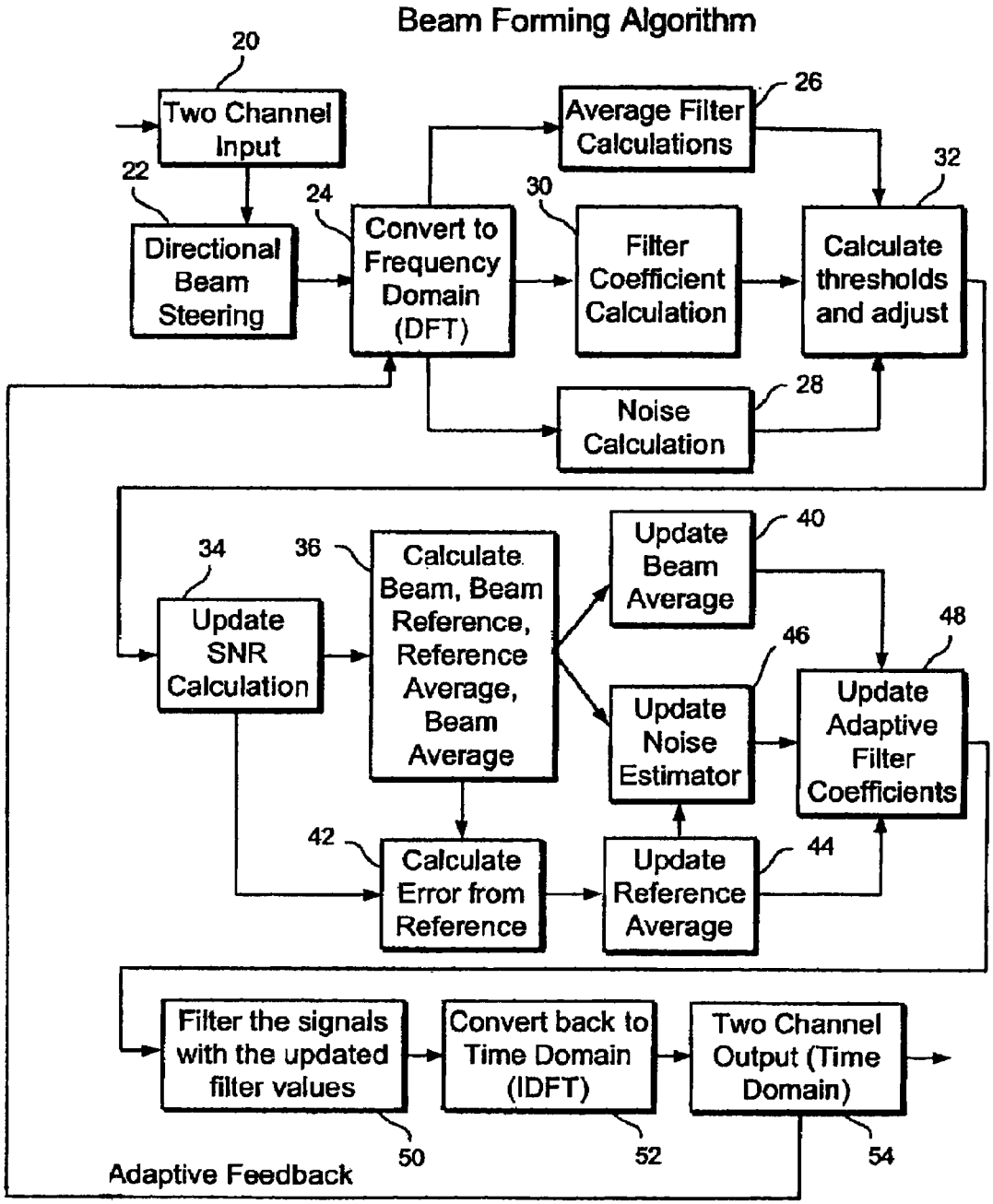
FIG. 1 is a schematic depicting a beam forming algorithm according to an embodiment of the invention.

According to an embodiment of the present invention, a sensor array, receives signals from a source. The digitized output of the sensors may then be transformed using a discrete Fourier transform (DFT).

The sensors of the sensor array preferably are microphones. In one embodiment the microphones are aligned on a particular axis. In the simplest embodiment the array comprises two microphones on a straight line axis. Normally, the array consists of an even number of sensors, with the sensors, according to one embodiment, at a fixed distance apart from each adjacent sensor. However, arrangements with sensors arranged along different axes or in different locations, with an even or odd number of sensors may be within the scope of the present invention.

According to an embodiment of the invention, the microphones generally are positioned horizontally and symmetrically with respect to a vertical axis. In such an arrangement there are two sets of microphones, one on each side of the vertical axis corresponding to two separate channels, a left and right channel, for example. In some embodiments, there may be one microphone on each side of the vertical axis. In some embodiments, there may be multiple microphones positioned on each side of the vertical axis. Microphones positioned in this manner may utilize broadside stereo beamforming.

In one embodiment, the microphones are digital microphones such as uni- or omni-directional electret microphones, or micro machined microelectromechanical systems (MEMS) microphones. The advantage of using the MEMS microphones is they have silicon circuitry that internally converts an audio signal into a digital signal without the need of an A/D converter, as other microphones would require. In any event, after the signals are digitized, according to an embodiment of the present invention, the signals travel through adjustable delay lines, such as suitable adjustable delay lines known in the art, that act as input into a processor, such as a microprocessor, microcontroller, digital signal processor, or combination thereof operating under the control of executable instructions stored in one or more suitable storage components (e.g., any combination of volatile/non-volatile memory components such as read-only memory (ROM), random access memory (RAM), electrically erasable programmable read-only memory (EE-PROM), etc.). It will also be recognized that instead of a processor that executes instructions, that the operations described herein may be implemented in discrete logic, state machines, or any other suitable combination of hardware and software.

The delay lines are adjustable, permitting a user to focus the direction from which the sensors or microphones receive sound/audio signals. This focused direction is referred to hereinafter as a "beam." In one embodiment, the delay lines are fed into the microprocessor of a computer. In this type of embodiment, the microprocessor may execute executable instructions suitable to generate a graphical user interface (GUI) indicating various characteristics about the received signal(s). The GUI may be generated on any suitable display, including an integral or external display such as a cathode-ray tube (CRT), liquid crystal display (LCD), light-emitting diode (LED) display, etc. In one example, the GUI may indicate the width of the beam produced by the array, the direction of the beam, and/or the magnitude of the sound/audio signal being received from a source. Furthermore, a user may interact with the GUI to adjust the delay lines carrying the received sound/audio signal(s) in order to affect beam steering (i.e., to modify the direction of the beam). For example, a user may adjust the delay lines by moving the position of a slider presented on the GUI, such as the "Beam Direction" slider illustrated in FIG. 11. Other suitable techniques known in the art for adjusting the delay lines are also envisioned.

The invention, according to one embodiment as presented in FIG. 1, produces substantial cancellation or reduction of background noise. After the steerable microphone array produces a two-channel input signal that may be digitized 20 and on which beam steering may be applied 22, the output may then be transformed using a DFT 24. It well known there are many algorithms that can perform a DFT. In particular a fast Fourier transform (FFT) maybe used to efficiently transform the data so that it may be more amenable for digital processing. The DFT processing may take place in on any suitable processor, such as any of the above-mentioned processors. After transformation, the data may be filtered according to the embodiment of FIG. 1.

This invention, in particular, applies an adaptive filter in order to efficiently filter out background noise. The adaptive filter may be a mathematical transfer function. As known in the art, an adaptive filter is a filter capable of changing its characteristics by modifying, for example, its filter coefficients. It is noted that the present invention is not limited to any particular type adaptive filter. For example, suitable adaptive filters are disclosed in applicant's commonly assigned and copending U.S. patent application Ser. No. 12/332,959, filed Dec. 11, 2008 entitled "Adaptive Filter in a Sensor Array System," applicant's commonly assigned U.S. Pat. No. 6,049,607, filed Sep. 18, 1998 entitled "Interference Cancelling Method and Apparatus," applicant's commonly assigned U.S. Pat. No. 6,594,367, filed Oct. 25, 1999 entitled "Super Directional Beamforming Design and Implementation," and applicant's commonly assigned U.S. Pat. No. 5,825,898, filed Jun. 27, 1996 entitled "System and Method For Adaptive Interference Cancelling." The above-listed patent application and each of the above-listed patents are incorporated by reference herein in their entirety. The filter coefficients of such adaptive filters help determine the performance of the adaptive filters. In the embodiment presented, the filter coefficients may be dependent on the past and present digital input.

An embodiment as shown in FIG. 1 discloses an averaging filter 26, such as a suitable averaging filter known in the art, that may be applied to the digitally transformed input to smooth the digital input and remove high frequency artifacts. This may be done for each channel. In addition the noise from each channel may also be determined 28. This may be accomplished, for example, in line with noise determination techniques set forth in applicant's commonly assigned U.S. Pat. No. 6,363,345, filed Feb. 18, 1999 entitled "System, Method and Apparatus for Cancelling Noise." Once the noise is determined, different variables may be calculated to update the adaptive filter coefficients 30. The channels are averaged using techniques known in the art and compared against a calibration threshold 32. Such a threshold is usually set by the manufacturer. If the result falls below a threshold, the values are adjusted by a weighting average function, such as a suitable weighting average function known in the art, so as to reduce distortion by a phase mismatch between the channels.

Another parameter that may be calculated, according the embodiment in FIG. 1, is the signal to noise ratio (SNR). The SNR may be calculated, in accordance with suitable SNR calculation techniques known in the art, from the averaging filter output and the noise calculated from each channel 34. The result of the SNR calculation triggers modifying the digital input using the filter coefficients of the previously calculated beam if it reaches a certain threshold. The threshold, which may be set by the manufacturer, may be a value in which the output may be sufficiently reliable for use in certain applications. In different situations or applications, a higher SNR may be desired, and the threshold may be adjusted by an individual.

The beam for each input may be continuously calculated. A beam may be calculated as the average of the two signals from the left and right channels, the average including the difference of angle between the target source and each of the channels. Along with the beam, a beam reference, reference average, and beam average may also calculated 36. The beam reference may be a weighted average of a previously calculated beam and the adaptive filter coefficients. A reference average may be the weighted sum of the previously calculated beam references. Furthermore, there may also be a calculation for beam average, which may be calculated as the running average of previously calculated beams. All these factors are used to update the adaptive filter. Additional details regarding the beam calculations may be found in Walter Kellermann, *Beamforming for Speech and Audio Signals*, in Handbook Of Signal Processing In Acoustics ch. 35 (David Havelock, Sonoko Kuwano, & Michael Vorländer eds., 2008).

Using the calculated beam and beam average, an error calculation may be performed by subtracting the current beam from the beam average 42. This error may then used in conjunction with an updated reference average 44 and updated beam average 40 in a noise estimation calculation 46. The noise calculation helps predict the noise from the system including the filter. The noise prediction calculation may be used in updating the coefficients of the adaptive filter 48 such as to minimize or eliminate potential noise.

After updating the filter and applying the digital input to it, the output of the filter may then be processed by an inverse discrete Fourier transform (IDFT). After the IDFT, the output then may be used in digital form as input into an audio application, such as, audio recording, VoIP, speech recognition in the same computer, or perhaps sent as input to another computing system for additional processing.

According to another embodiment, the digital output from the adaptive filter may be reconverted by a D/A converter into an analog signal and sent to an output device. In the case of an audio signal, the output from the filter may be sent as input to another computer or electronic device for processing. Or it may be sent to an acoustic device such as a speaker system, or headphones, for example.

The algorithm, as disclosed herein, may advantageously be able to produce an effective filtering of noise, including filtering of non-stationary or sudden noise such as a door slamming. Furthermore, the algorithm allows superior filtering, at lower frequencies while also allowing the microphone spacing small, such as little as 5 inches in a two element microphone embodiment. Previously microphone arrays would require a substantially greater amount of spacing, such as a foot or more, in order to provide equivalent filtering at lower frequencies.

Another advantage of the algorithm as presented is that it, for the most part, may require no customization for a wide range of different spacing between the elements in the array. The algorithm may be robust and flexible enough to automatically adjust and handle the spacing in a microphone array system to work in conjunction with common electronic or computer devices.

Various embodiments may include using an audio transmitting/receiving device utilizing one or more algorithms. In some embodiments, an audio transmitting/receiving device may be configurable to work with commercially available algorithms.

Figure 2:
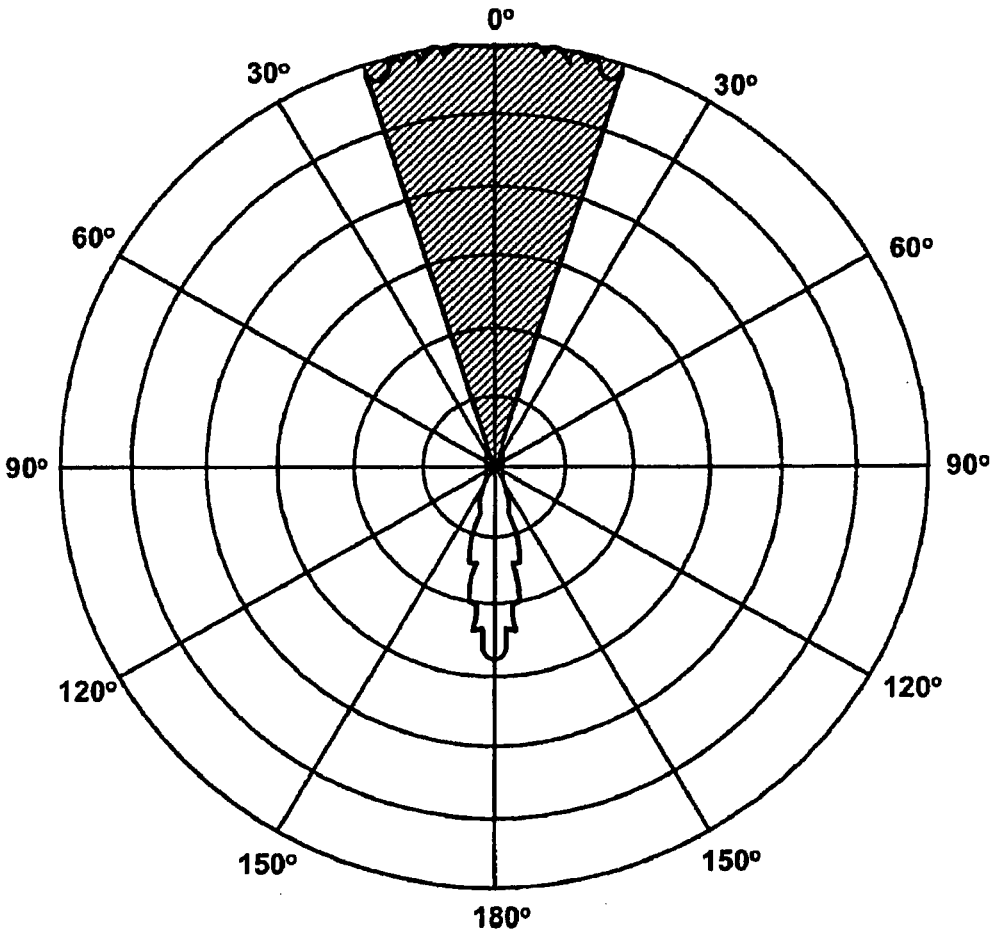
FIG. 2 is a drawing depicting a polar beam plot of a 2 member microphone array, according to one embodiment of the invention.

FIG. 2 shows a polar beam plot of a 2 member microphone array according to an embodiment of the invention when the delays lines of the left and right channels are equal. If the speakers are placed outside of the main beam, the array then attenuates signals originating from such sources which lie outside of the main beam, and the microphone array acts as an echo canceller with there being no feedback distortion. The beam typically will be focused narrowly on the target source, which is typically the human voice. When the target moves outside the beam width, the input of the microphone array shows a dramatic decrease in signal strength.

Figure 3:
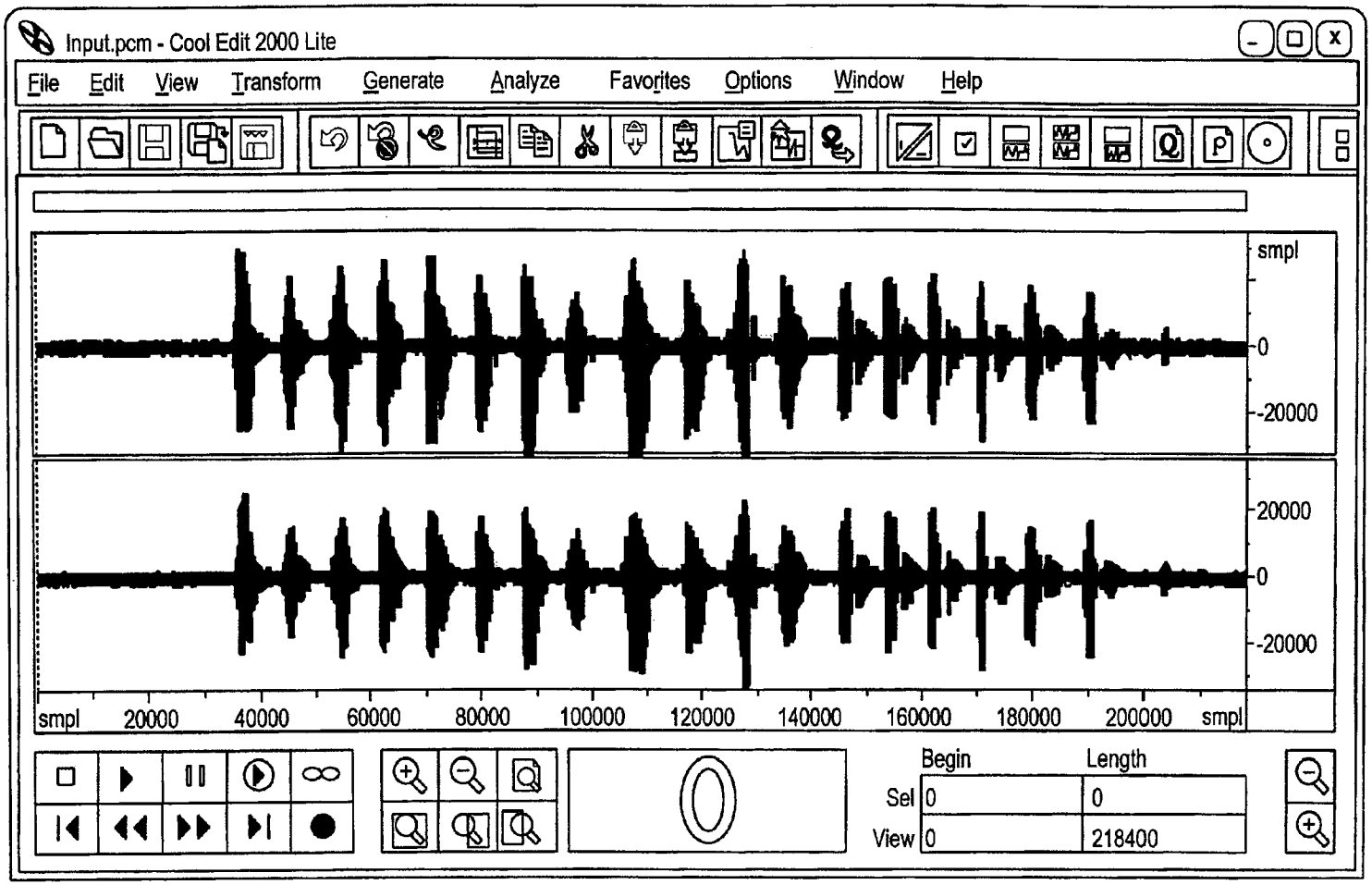
FIG. 3 shows an input wave file that is fed into a Microsoft® array filter and an array filter according to one embodiment of the present invention.

A research study comparing Microsoft®'s microphone array filters (embedded in the new Vista® operating system) and the microphone array filter according to the present invention is discussed herein. The comparison was made by making a stereo recording using the Andrea® Superbeam array. This recording was then processed by both the Microsoft® filters and the microphone array filter according to the present invention using the exact same input, as shown in FIG. 3. The recording consisted of:

1. A voice counting from 1 to 18, while moving in a 180 degree arc in front of the array.

2. A low level white noise generator was positioned at an angle of 45 degrees to the array.

3. The recording was at a sampling rate of 8000 Hz, 16-bit audio, which is the most common format used by VoIP applications.

For the Microsoft® filters test, their Beam Forming, Noise Suppression and Array Pre-Processing filters were turned on. For the instant filters test, the DSDA®R3 and PureAudio® filters were turned on, thus given the best comparison of the two systems.

Figure 4:
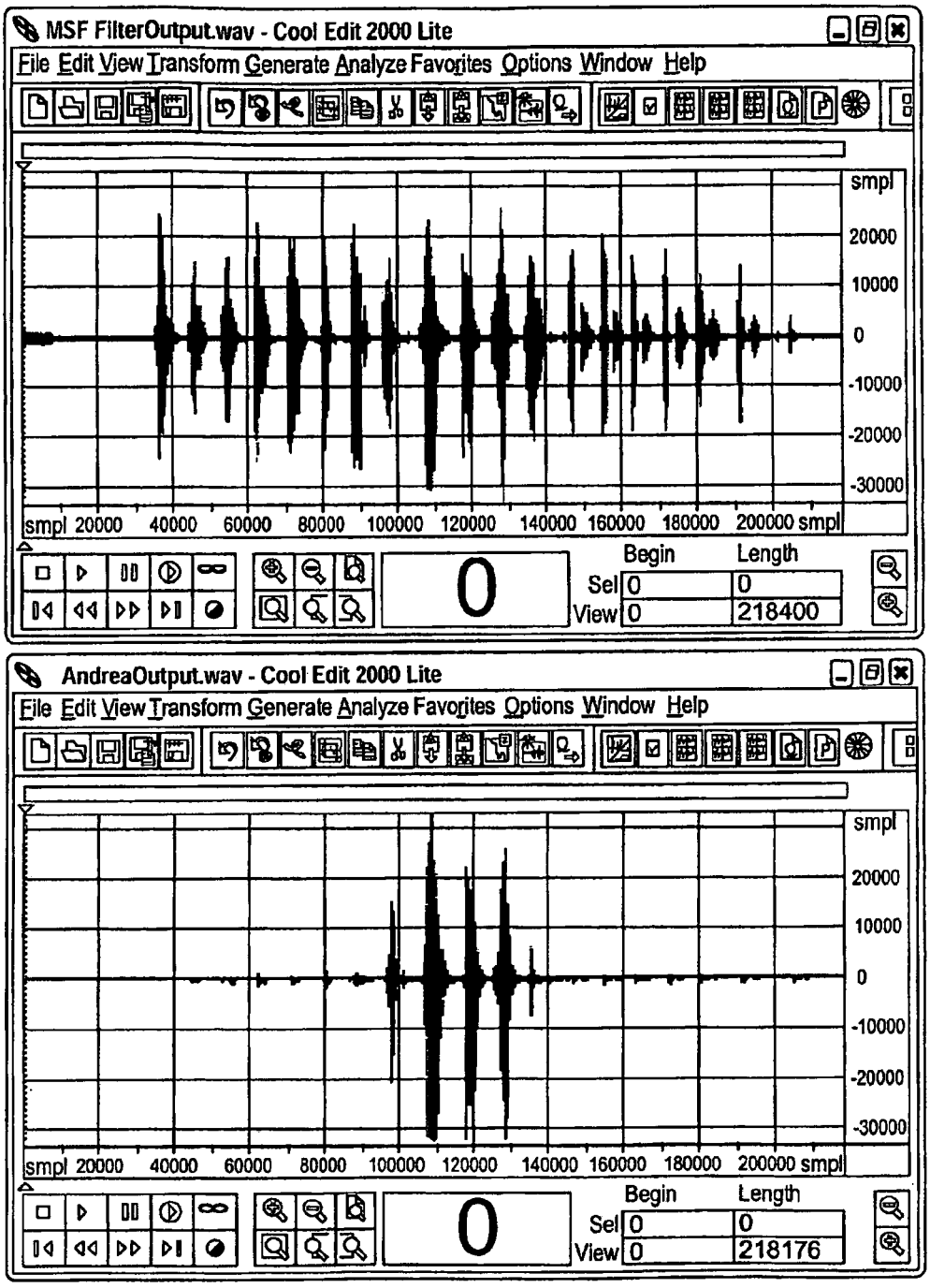
FIG. 4 depicts a comparison between the filtering of Microsoft® array filter with an array filter according to one embodiment of the present invention.

FIG. 4 shows the output wave files from both the filters. While the Microsoft® filters do improve the audio input quality, they use a loose beam forming algorithm. It was observed that it improves the overall voice quality, but it is not as effective as the instant filters, which are designed for environments where a user wants all sound coming from the side removed, such as voices or sound from multimedia speakers. The Microsoft® filters removed 14.9 dB of the stationary background noise (white noise), while the instant filters removed 28.6 dB of the stationary background noise. Also notable is that the instant beam forming filter has 29 dB more directional noise reduction of non-stationary noise (voice/music etc.) than the Microsoft® filters. The Microsoft® filters take a little more than a second before they start removing the stationary background noise. However, the instant filters start removing it immediately.

As shown in FIG. 4, the 120,000 mark on the axis represents when a target source or input source is directly in front of the microphone array. The 100,000 and 140,000 marks correspond to the outer parts of the beam as shown in FIG. 2. FIG. 4 shows, for example, a comparison between the filtering of Microsoft® array filter with an array filter disclosed according to an embodiment of the present invention. As soon as the target source falls outside of the beam width, or the 100,000 or 140,000 marks, there is very noticeably and dramatic roll off in signal strength in the microphone array using an embodiment of the present invention. By contrast, there is no such roll off found in Microsoft® array filter.

As someone in the art would recognize, the invention as disclosed, the sensor array could be placed on or integrated within different types of devices such as any devices that requires or may use an audio input, like a computer system, laptop, cellphone, gps, audio recorder, etc. For instance in a computer system embodiment, the microphone array may be integrated, wherein the signals from the microphones are carried through delay lines directly into the computer's microprocessor. The calculations performed for the algorithm described according to an embodiment described herein may take place in a microprocessor, such as an Intel® Pentium® or AMD® Athlon® Processor, typically used for personal computers. Alternatively the processing may be done by a digital signal processor (DSP). The microprocessor or DSP may be used to handle the user input to control the adjustable lines and the beam steering.

Alternatively in the computer system embodiment, the microphone array and possibly the delay lines may be connected, for example, to a USB input instead of being integrated with a computer system and connected directly to a microprocessor. In such an embodiment, the signals may then be routed to the microprocessor, or it may be routed to a separate DSP chip that may also be connected to the same or different computer system for digital processing. The microprocessor of the computer in such an embodiment could still run the GUI that allows the user to control the beam, but the DSP will perform the appropriate filtering of the signal according to an embodiment of an algorithm presented herein.

Figure 5:
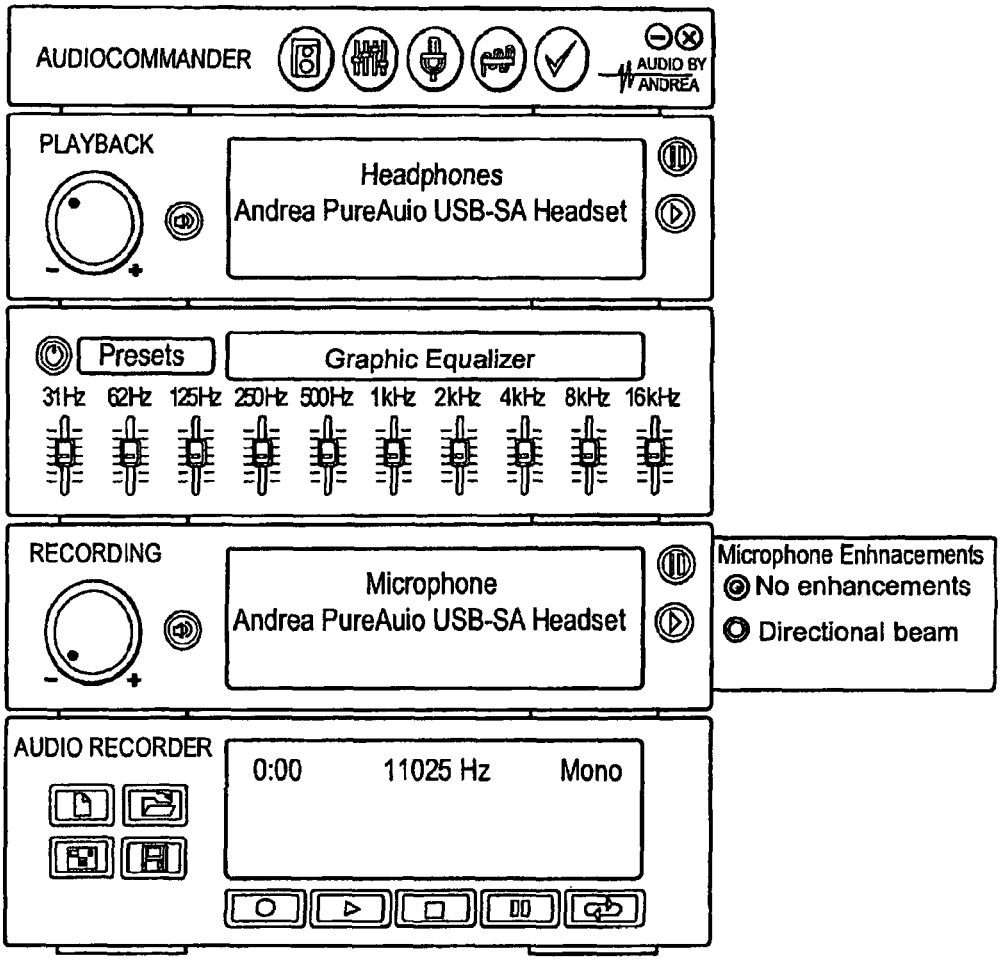
FIG. 5 is a depiction of an example of a visual interface that can be used in accordance with the present invention.
Figure 6:
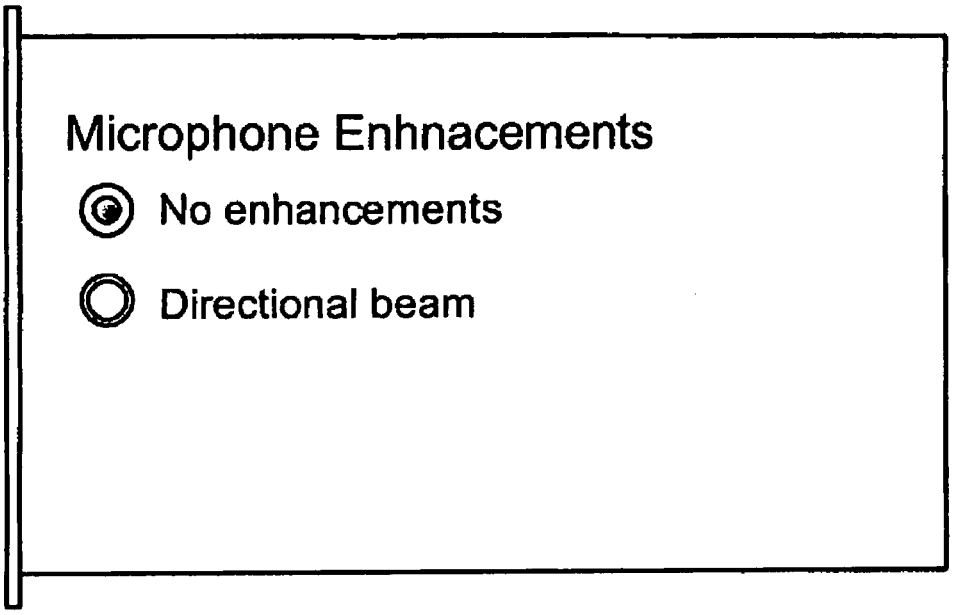
FIG. 6 is a portion of the visual interface shown in FIG. 5.
Figure 7:
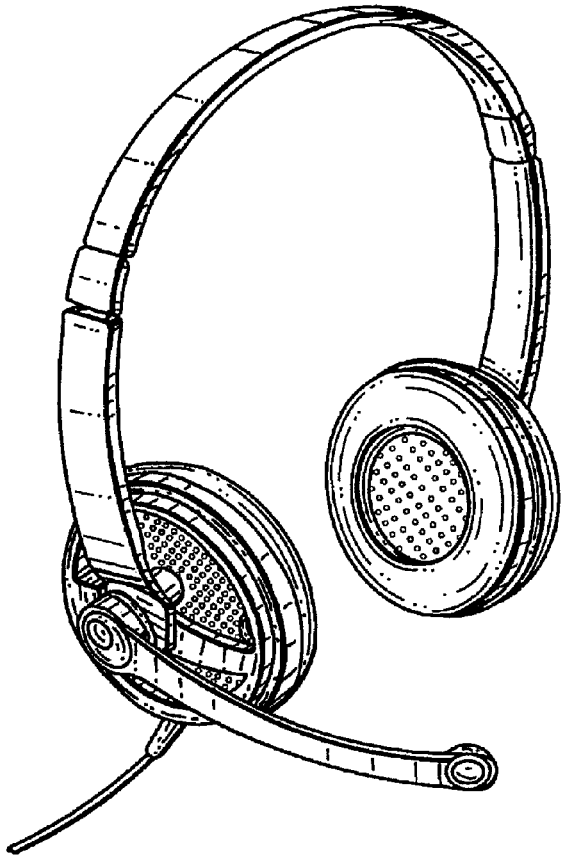
FIG. 7 (PRIOR ART)
FIG. 7 is a photograph of a headset from prior art.

In some embodiments, the spacing of the microphones in the sensor array maybe adjustable. By adjusting the spacing, the directivity and beam width of the sensor may be modified. FIGS. 5 and 6 show different aspects of embodiments of the microphone array and different visual user interfaces or GUIs that may be used with the invention as disclosed. FIG. 6 is a portion of the visual interface as shown in FIG. 5.

Figure 8:
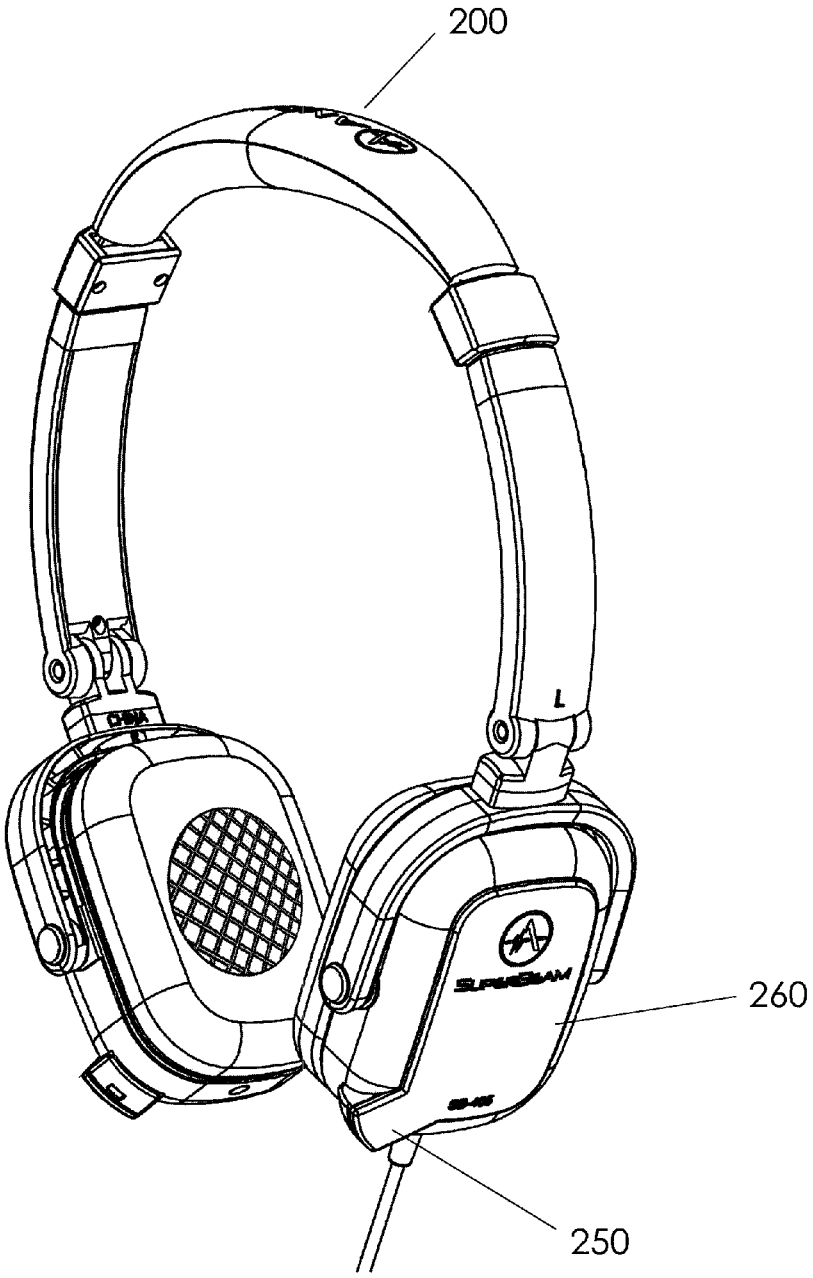
FIG. 8 is a photograph of a headset with microphones on either side, according to one embodiment of the invention.
Figure 9A:
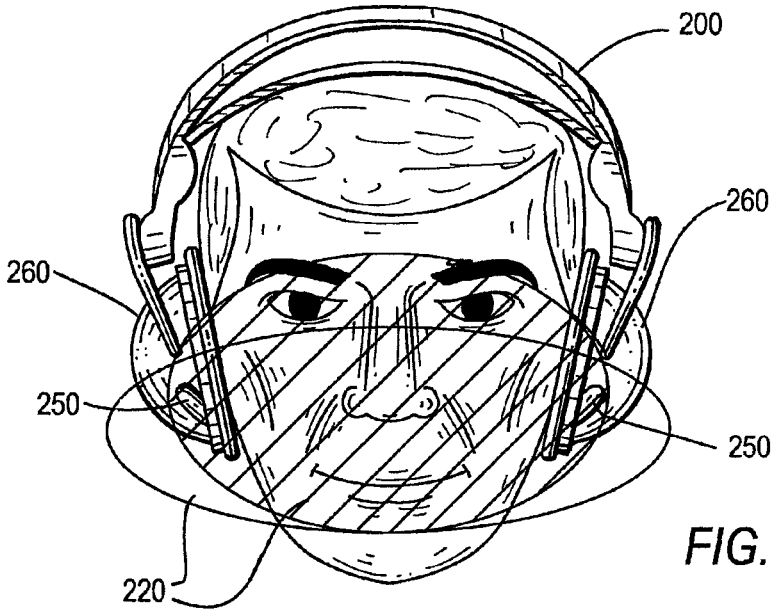
FIG. 9(*a*)-9(*d*) are illustrations of the headset, according to one embodiment of the invention.
Figure 9B:
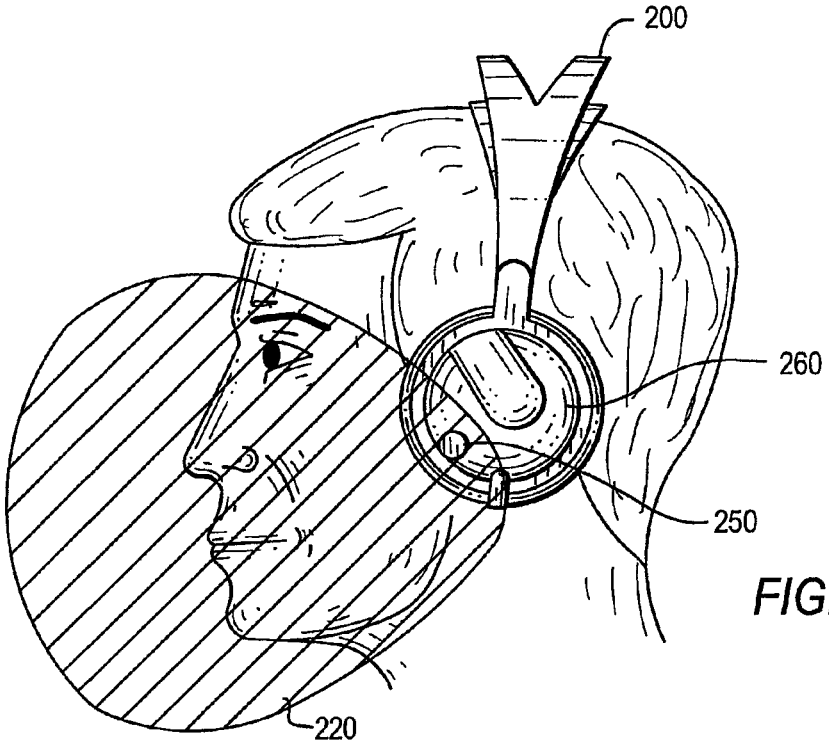
Figure 9C:
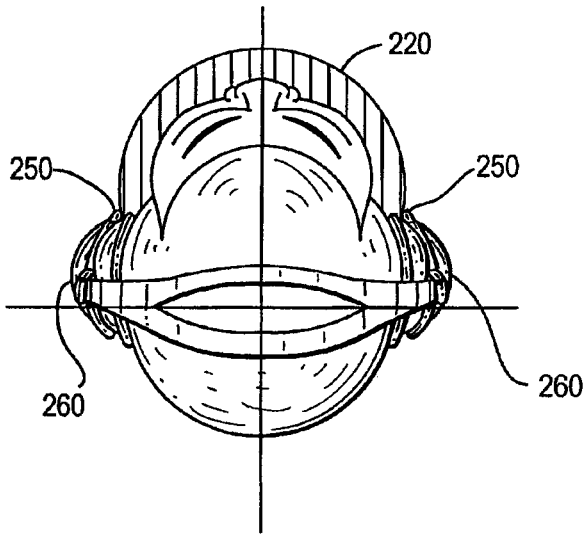
Figure 9D:
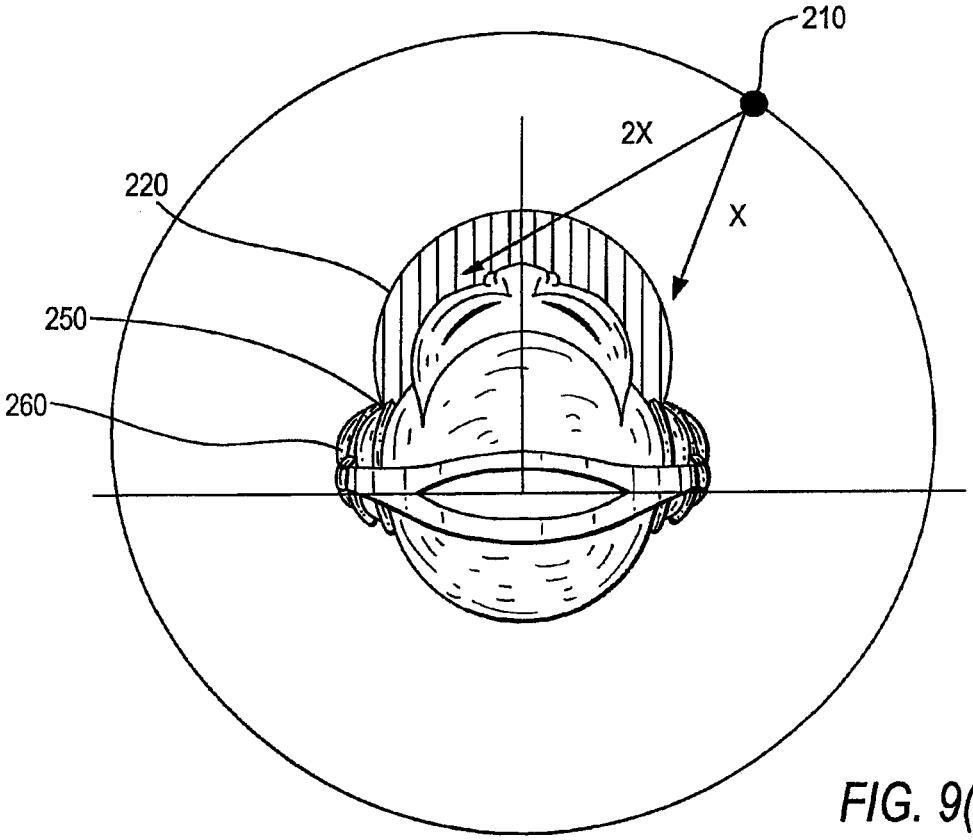

The invention according to an embodiment may be an integrated headset system 200, a highly directional stereo array microphone with reception beam angle pointed forward from the ear phone to the corner of a user's mouth, as shown in FIG. 8. As shown in FIG. 8, headset system 200 is a circumaural headset. In some embodiments, a supra-aural headset using headphones 302 (shown in FIGS. 12*a*-*b*), earbuds 303 (shown in FIG. 13), and/or one or more earphones may be utilized.

The pick-up angles or the angles in which the microphones 250 pick up sound from a sound source 210 is shown in FIG. 9(*d*), for example, in front of the array, while cancellation of all sounds occurs from side and back directions. Different views of this pick-up 'area' 220 are shown in FIGS. 9(*a*)-9(*c*). Cancellation is approximately 30 dB of noise, including speech noise.

According to an embodiment, left and right microphones 250 are mounted on the lower front surface of the earphone 260. They are, preferably, placed on the same horizontal axis. As shown in FIGS. 9(*a*)-(*d*), the user's head may be centered between the two earphones 260 and may act as additional acoustic separation of the microphone elements 250. The spacing of microphones may range anywhere from about 5 to 7 inches, for example. In some embodiments, during use the microphone elements may be separated by the width of a head. This may vary greatly depending upon the age and size of the user. In some embodiments, the spacing between the microphone elements may be in a range from about 3 to 8 inches.

By adjusting the spacing between microphone elements 250, the beam width may be adjusted. The closer the microphones are, the wider the beam becomes. The farther apart the microphones are, the narrower the beam becomes. It is found that approximately 7 inches achieves a more narrow focus on to the corner of the user's mouth, however, other distances are within the scope of the instant invention. Therefore, any acoustic signals outside of the array microphones forward pick up angle are effectively cancelled.

Figure 10:
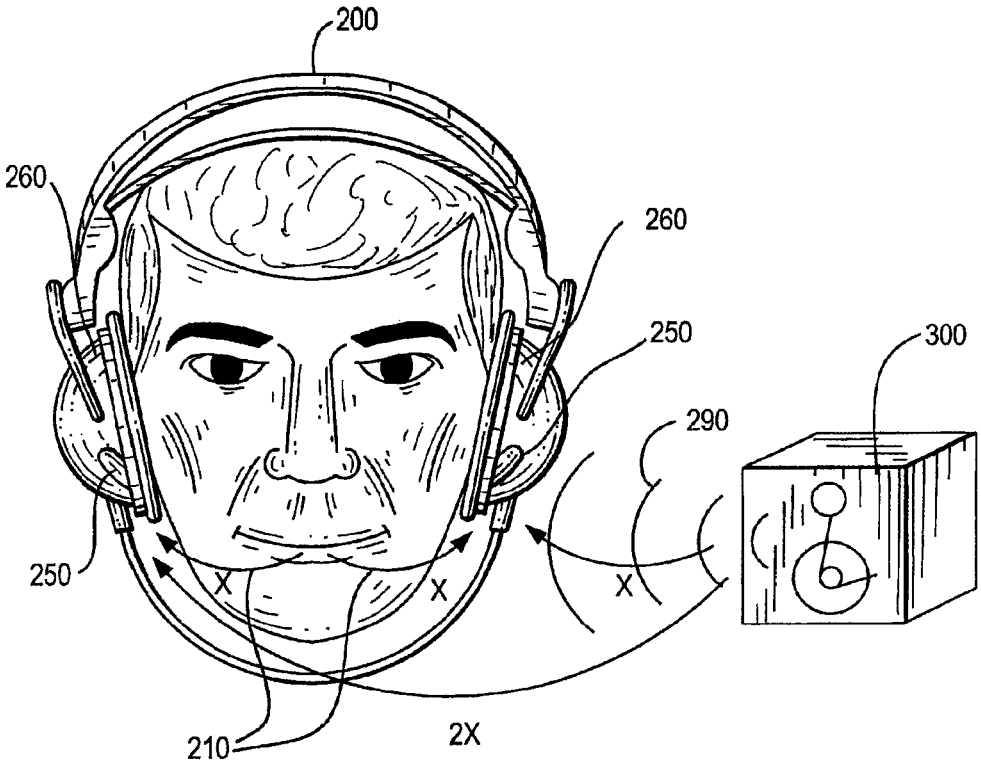
FIG. 10 is an illustration of the functioning of the headset with microphones, according to one embodiment of the invention.

The stereo microphone spacing allows for determining different time of arrival and direction of the acoustic signals to the microphones. From the centered position of the mouth, the voice signal 210 will look like a plain wave and arrive in-phase at same time with equal amplitude at both the microphones, while noise from the sides will arrive at each microphone in different phase/time and be cancelled by the adaptive processing of the algorithm. Illustration of such an instance is clearly shown in FIG. 10, for example, where noise coming from a speaker 300 on one side of the user is cancelled due to varying distances (X, 2X) of the sound waves 290 from either microphone 250. However, the voice signal 210 travels an equidistant (Y) to both microphones 250, thus providing for a high fidelity far field noise canceling microphone that possesses good background noise cancellation and that may be used in any type of noisy environment, especially in environments where a lot of music and speech may be present as background noise (as in a game arena or internet cafe).

Figure 12A:
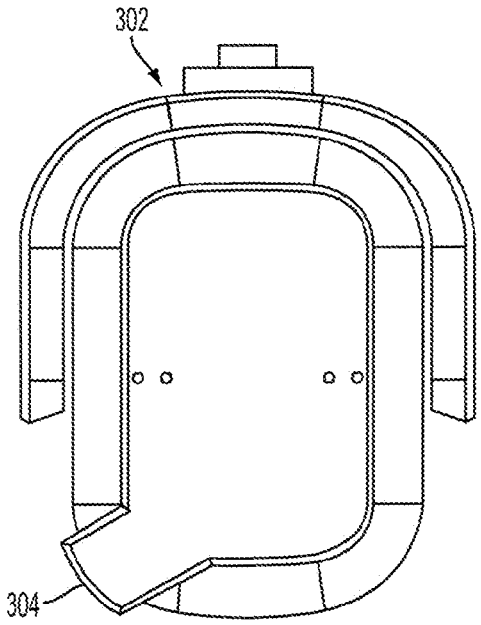
FIG. 12 is a side view of an embodiment of headphones for use with a supra-aural headset.
Figure 12B:
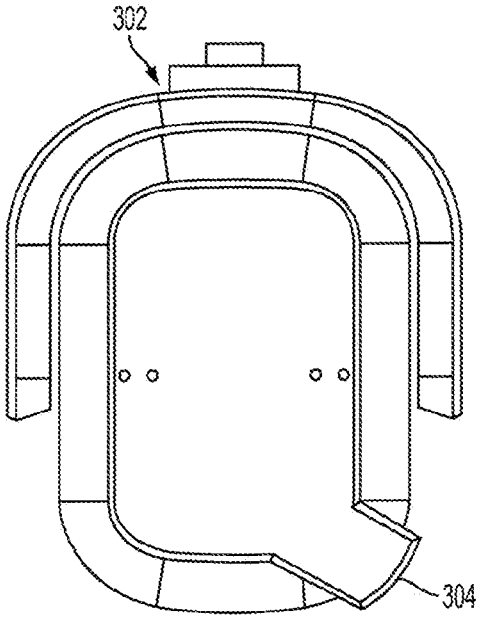
Figure 14:
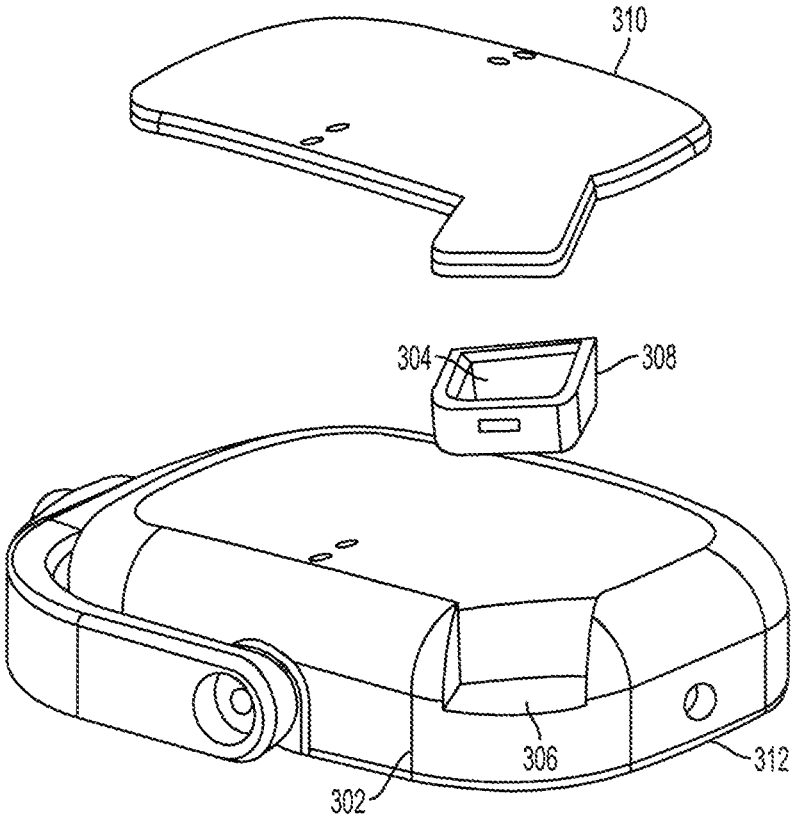
FIG. 14 is an exploded perspective view of an embodiment of a headphone for use with a headset.

The two elements or microphones 250 of the stereo headset-microphone array device may be mounted on the left and right earphones of any size/type of headphone. The microphones 250 may be protruding outwardly from the headphone, or may be adjustably mounted such that the tip of the microphone may be moved closer to a user's mouth, or the distance thereof may be optimized to improve the sensitivity and minimize gain. FIGS. 12*a-b* depict headphones 302 having microphone elements 304 extending beyond the headphones. Acoustic separation may be considered between the microphones and the output of the earphones, as not to allow the microphones to pick up much of the received playback audio (known as crosstalk or acoustic feedback). Any type of microphone or microphone element may be used, such as for example, uni-directional or omni-directional microphones. As shown FIG.14, microphone element 304 may be configured to be positioned within headphone 302 in opening 306. Housing 308 and plate 310 may be used to acoustically isolate microphone element 304.

In some embodiments, the microphone elements may be acoustically isolated from the speakers to inhibit vibration transmission through the housing and into the microphone element, which might otherwise lead to irritating feedback. Any type of microphone may be used, such as for example, uni-directional or omni-directional microphones.

As shown in FIGS. 8, 14-15, and 33, one or more sealing members 312 may be used to acoustically isolate microphone elements 304 from speaker elements (not shown). An acoustic seal may be formed between a portion of the ear or head and the device utilizing a sealing member. Sealing members may be constructed from materials including, but not limited to padding, synthetic materials, leather, rubber materials, covers such as silicon covers, an materials known in the art and/or combinations thereof.

Figure 13:
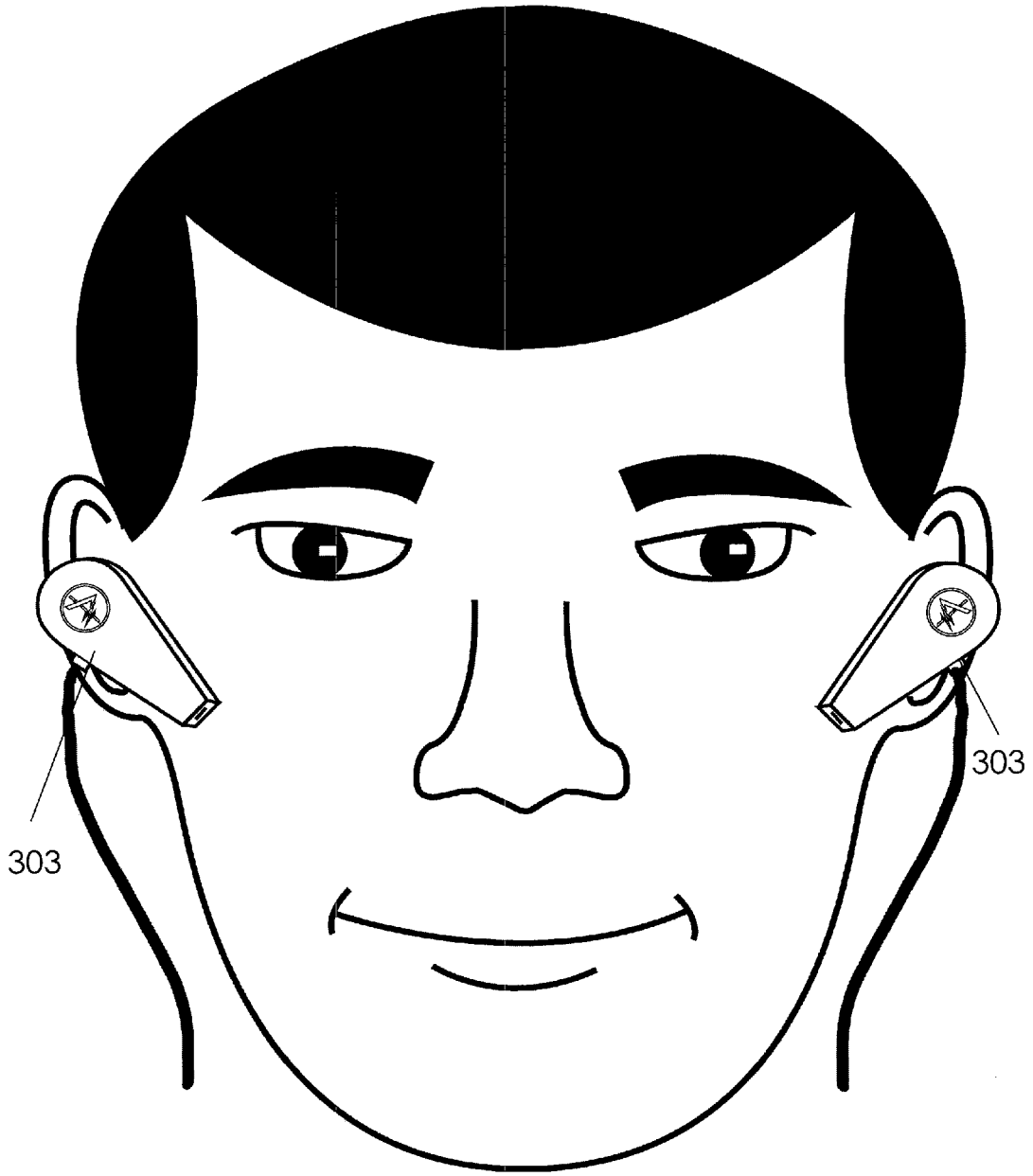
FIG. 13 is an illustration of a user wearing an embodiment of a set of earbuds having stereo microphones.

Some embodiments of an audio transmitting/receiving device may include one or more earbuds with an integrated array of microphones. As shown in FIG. 13, an audio transmitting/receiving device may include a set of earbuds 303 with an integrated array of microphone elements 304. Utilizing a set of earbuds as depicted in FIG. 13 may allow the user to listen and record signals in stereo.

As is shown in FIG. 13, a set of earbuds 303 having speakers (not shown) and integrated microphone elements 304 may utilize one or more algorithms to enhance and/or modifying the quality of the sound delivered and/or recorded using earbuds 303.

Figure 15:
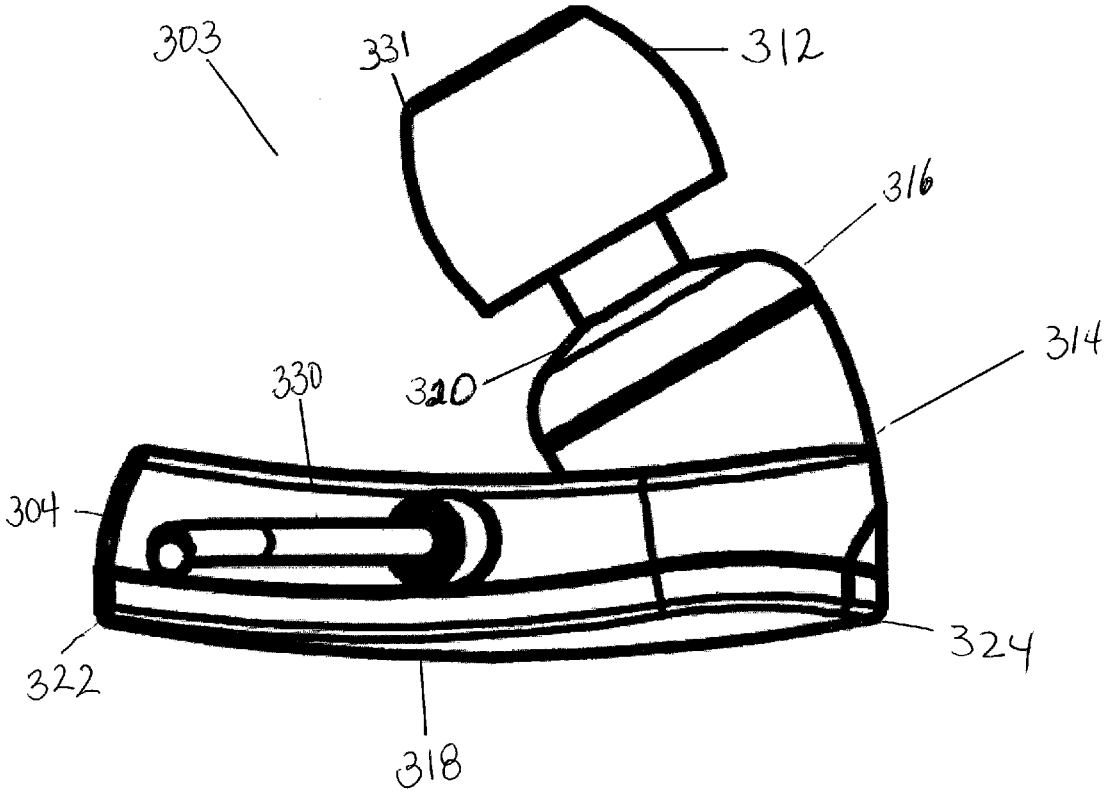
FIG. 15 is a side view of an embodiment of an earbud.

As shown in FIG. 15, earbud 303 may include housing 314 and sealing member 312. Housing 314 includes body 316 having elongated portion 318 and projecting portion 320.

Figure 16:
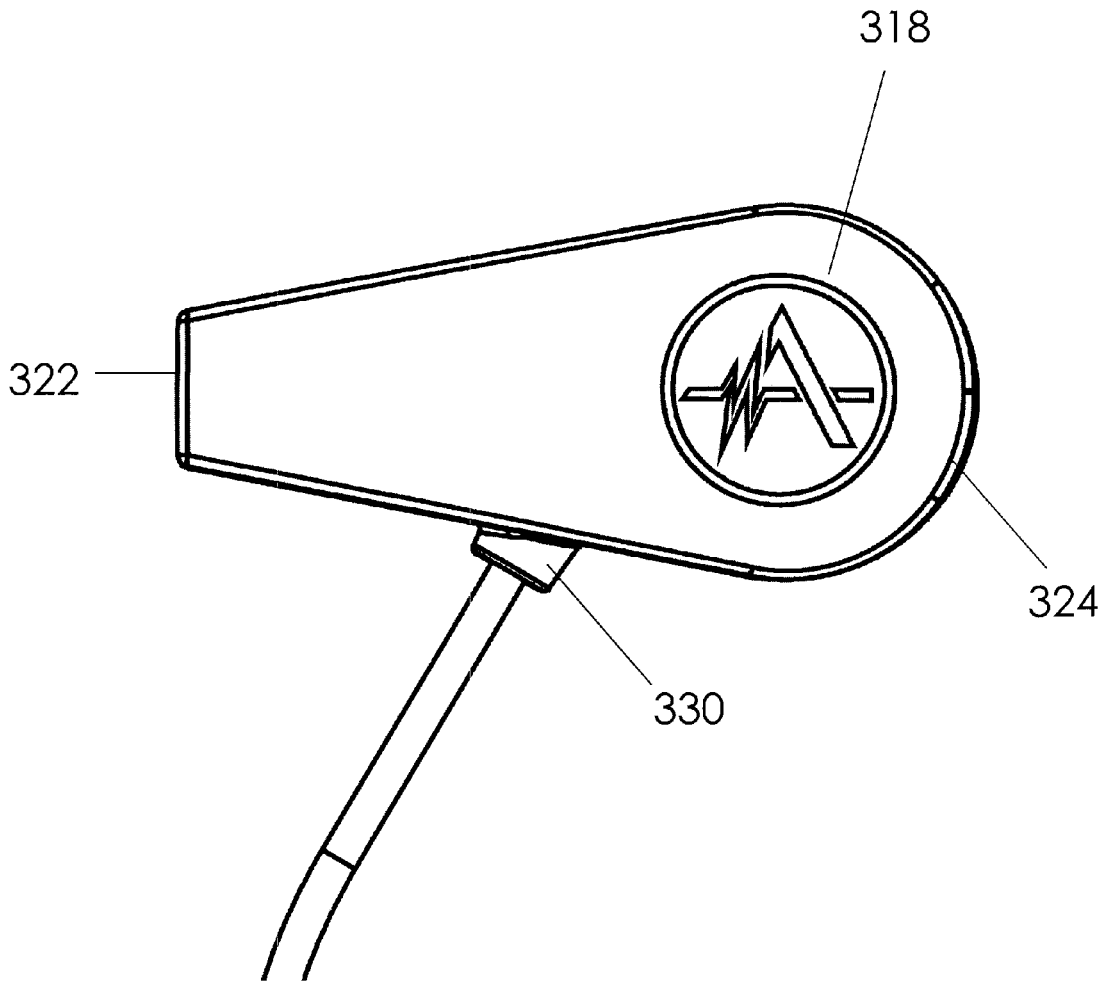
FIG. 16 is a side view of an embodiment of an earbud.

As shown in FIGS. 15-16 elongated portion 318 may have a length from distal end 322 to proximate end 324 in a range from about 0.1 inches to about 7 inches. Various embodiments include an elongated portion having a length in a range from about 0.5 inches to about 3 inches. Some embodiments may include an elongated portion having a length in a range from about 1 inch to about 2 inches. An embodiment may include an elongated portion having a length in a range from about 1.25 inches to about 1.75 inches. For example, elongated portion may have a length of about 1.5 inches.

Figure 17:
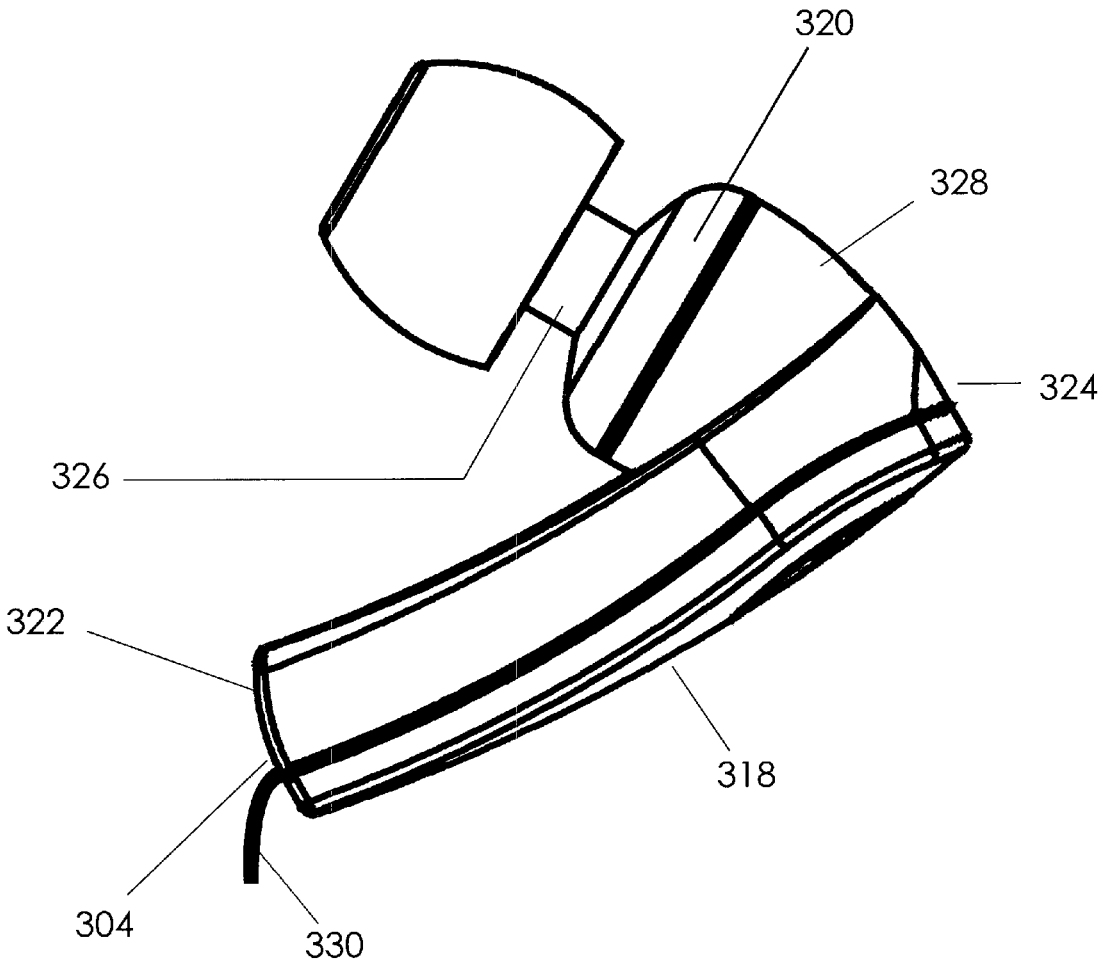
FIG. 17 is a photograph of a side view of an embodiment of an earbud with a microphone on a distal end.

In some embodiments, microphone element 304 may be positioned at distal end 322 of elongated portion 318 as shown in FIG. 17. Projecting portion 320 is positioned at proximal end 324 as shown in FIG. 17. In various embodiments, positioning microphone element 304 closer to a user's mouth during use may increase the ability of the microphone element to pick up sound of the voice. Thus, in such embodiments the closer the microphone is positioned to the mouth, the less sensitive the microphone needs to be. Lower sensitivity microphones may increase the ability of the system to remove background noise from a signal in some embodiments. In some embodiment, the closer to a user's mouth the microphone element is positioned, the easier it is to separate the signal from the user's voice.

Figures 18A, 18B, 18C:
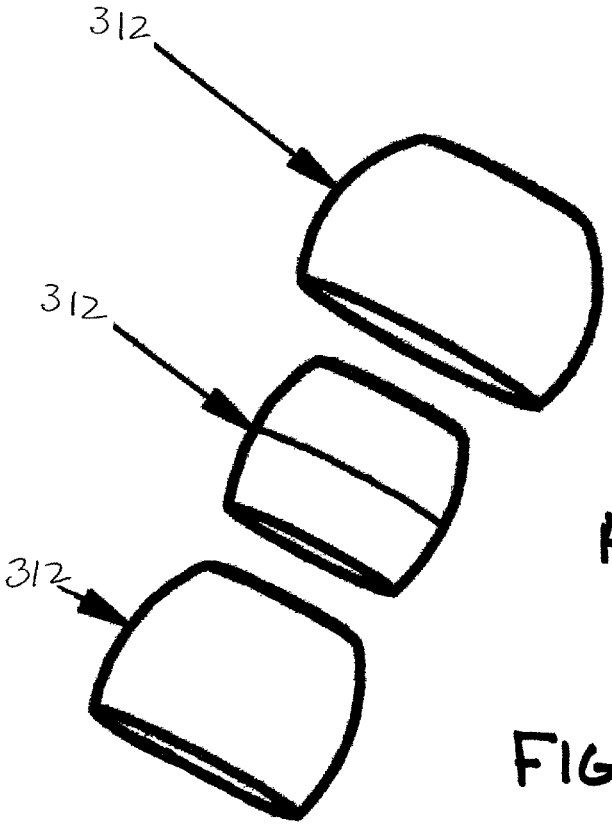
FIGS. 18*a-c* are side views of various embodiments of sealing members.

Projecting portion 320 may extend from elongate portion 318 as shown in FIG. 17. As depicted, projecting portion includes stem 326 and speaker housing 328. In some embodiments, stem 326 having an end configured to accept a sealing member as is illustrated. As shown in FIGS. 18*a-c*, a shape of sealing member 312 may vary. In some embodiments, various shapes may ensure that a user can find a cover capable of comfortably forming a seal in the user's ear. Sealing members may be constructed from various materials including but not limited to silicon, rubber, materials known in the art or combinations thereof.

Figure 19:
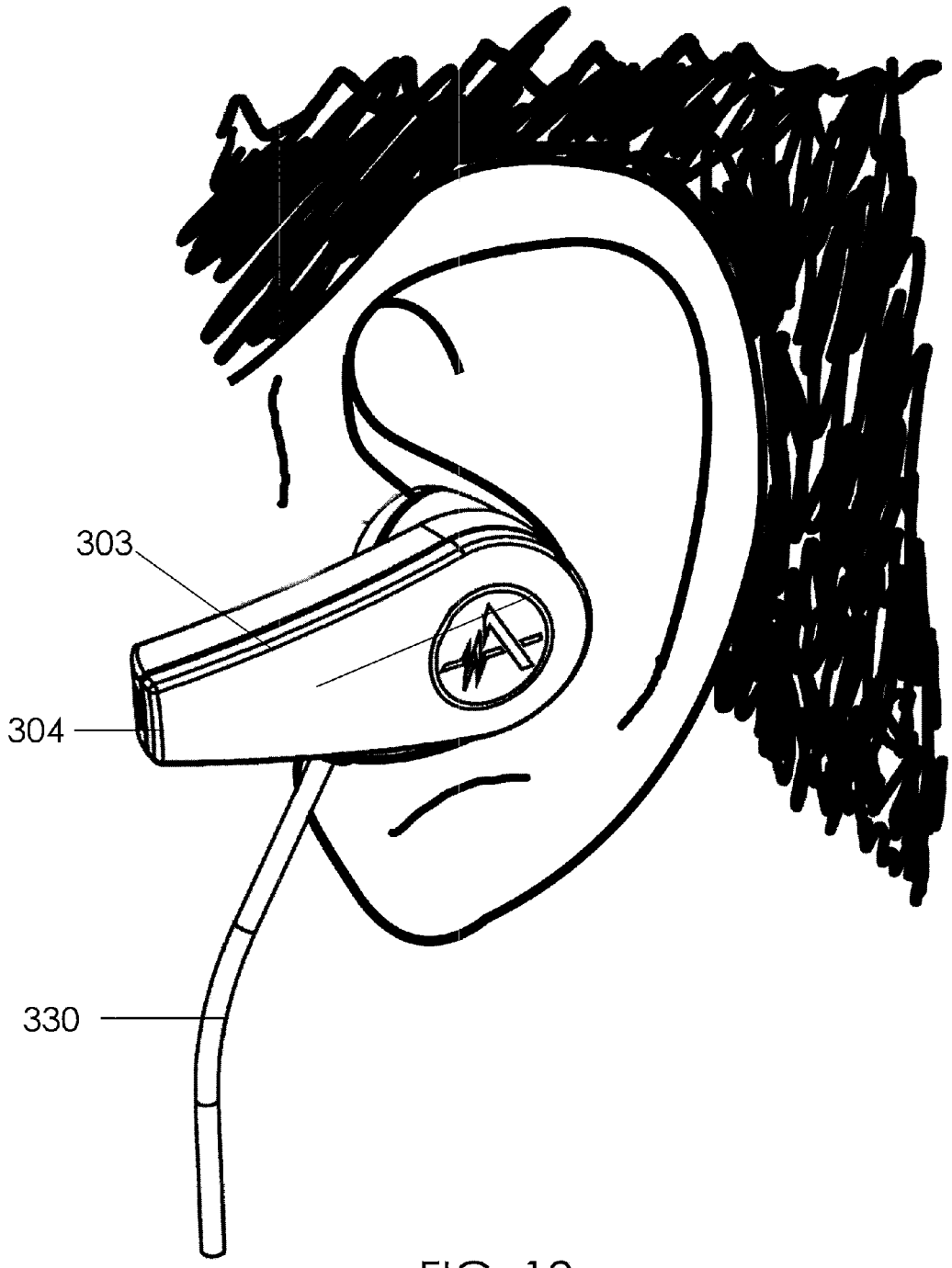
FIG. 19 is an illustration of an embodiment of an earbud positioned in an ear during use.

Various embodiments may include a stem or unitary projecting portion capable of being positioned within a user's ear without the use of a cover. As shown in FIG. 19, earbud 303 may be configured to fit snugly in the ear by frictional contact with surrounding ear tissue. In some embodiments, a seal member may be positioned over a portion of the projecting portion and/or the stem to increase frictional contact with the user's surrounding ear.

The housing of the earbud may be constructed of any suitable materials including, but not limited to plastics such as acrylonitrile butadiene styrene ("ABS"), polyvinyl chloride ("PVC"), polycarbonate, acrylics such as poly(methyl methacrylate), polyethylene, polypropylene, polystyrene, polyesters, nylon, polymers, copolymers, composites, metals, other materials known in the art and combinations thereof. In some embodiments, materials which minimize vibrational transfer through the housing may be used.

In some embodiments, projecting portion 320 may have a length sufficient to reduce the likelihood that elongated section 318 touches the ear and/or face of the user during use. Various embodiments may include projecting portion 320 having a length sufficient to ensure that body 316 does not contact the ear and/or face of the user during use.

Projecting portion may have a length in a range from about 0.1 inches to about 3 inches. In some embodiments, a length of the projecting portion may be in a range from about 0.2 inches to about 1.25 inches. Various embodiments may include a projecting portion having a length in a range from about 0.4 inches to about 1.0 inches. As earbud 303 is depicted in FIG. 15, the length of projecting portion 320 is in a range from about 0.5 inches to about 0.9 inches.

Figure 20:
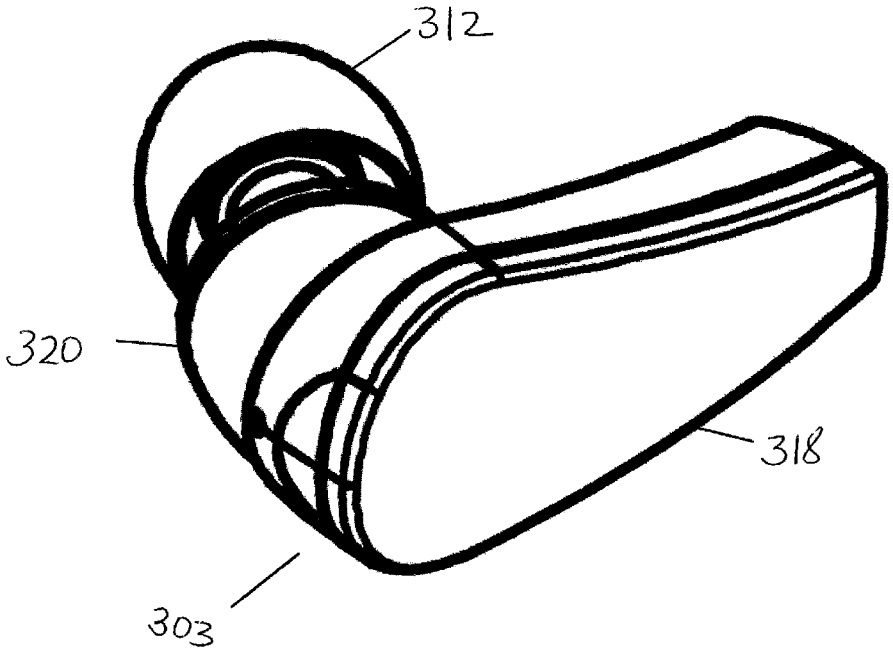
FIG. 20 is a perspective view of an embodiment of an earbud.

Connecting means 330 extends from body 316 as depicted in FIGS. 15-17 and 19. Connecting means may include, but is not limited to wires, cables, wireless technologies, any connecting means known or yet to be discovered in the art or a combination thereof. Thus, in some embodiments the connecting means may be internal as shown in FIG. 20.

In some embodiments, a distance between a position of microphone element 304 and a end 331 of the projecting portion 320 may be in a range from about 0.1 inches to about 3 inches as shown in FIG. 15. Various embodiments include a distance between a position of microphone element 304 and end 331 of the projecting portion 320 in a range from about 0.3 inches to about 1.5 inches. Embodiments may include a distance between a position of microphone element 304 on distal end 322 of elongated portion 318 and end 331 of the projecting portion 320 in a range from about 0.4 inches to about 1.2 inches. As depicted in FIG. 16, a distance between a position of microphone element 304 and end 331 of the projecting portion 320 may be in a range from about 0.6 inches to about 1.1 inches. For example, a distance between a position of microphone element 304 and end 331 of the projecting portion 320 may be in a range from about 0.7 inches to about 1.0 inches.

Figure 21:
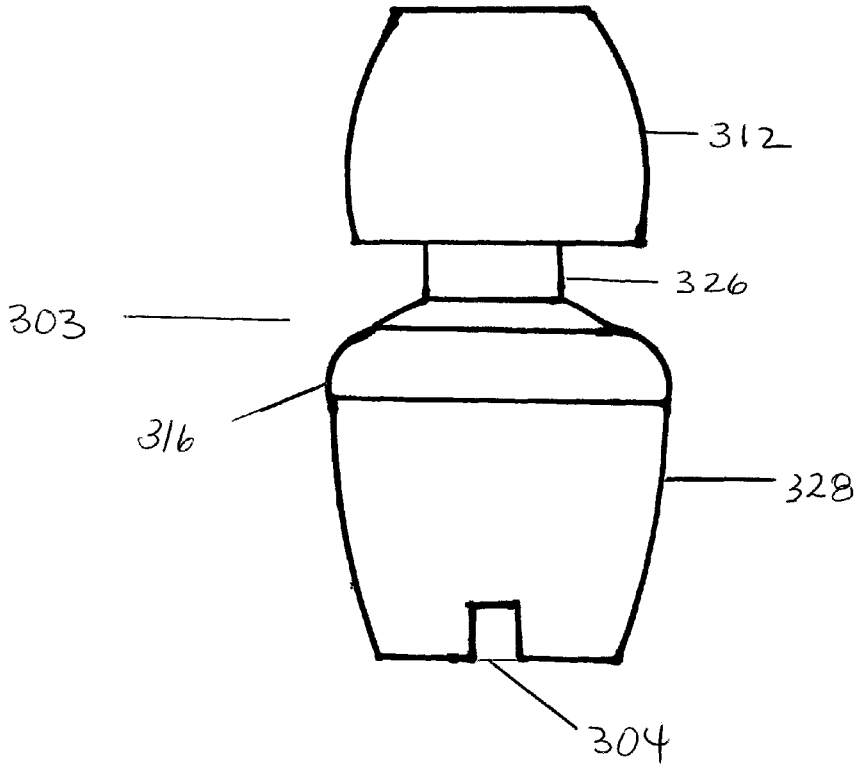
FIG. 21 is a side view of an embodiment of an earbud.

FIGS. 17 and 19 depict elongated portion 318 having microphone 304 positioned at distal end 322. In some embodiments, one or more microphone elements may be positioned on the speaker housing as is depicted in FIG. 21. Such arrangements may be useful when an earbud set is utilized for stereo recording such as a surround sound recording.

As shown in FIGS. 22-27 housing 314 (shown in FIG. 15) may be constructed using multiple pieces. In some embodiments, pieces may be formed, injection molded, constructed using any method known in the art or combinations thereof. Housing 314 may include transmitter section 332, inner section 334 and outer section 336, as is shown in FIGS. 22-27.

Figure 22:
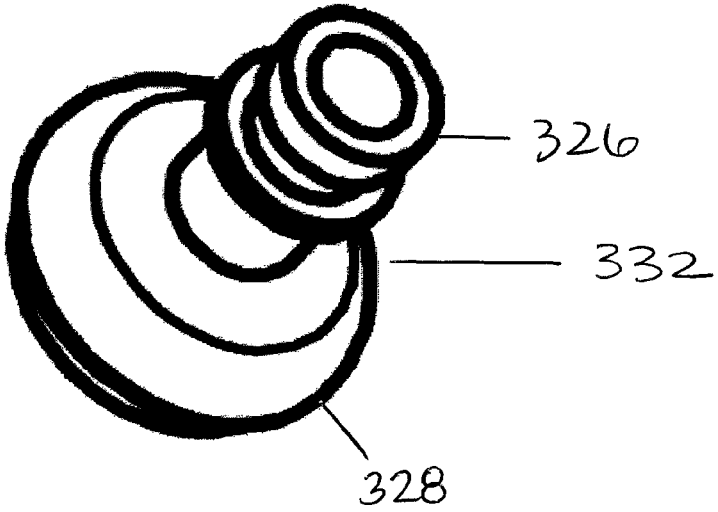
FIG. 22 is a perspective view of an embodiment of a portion of the housing of an earbud.
Figure 23:
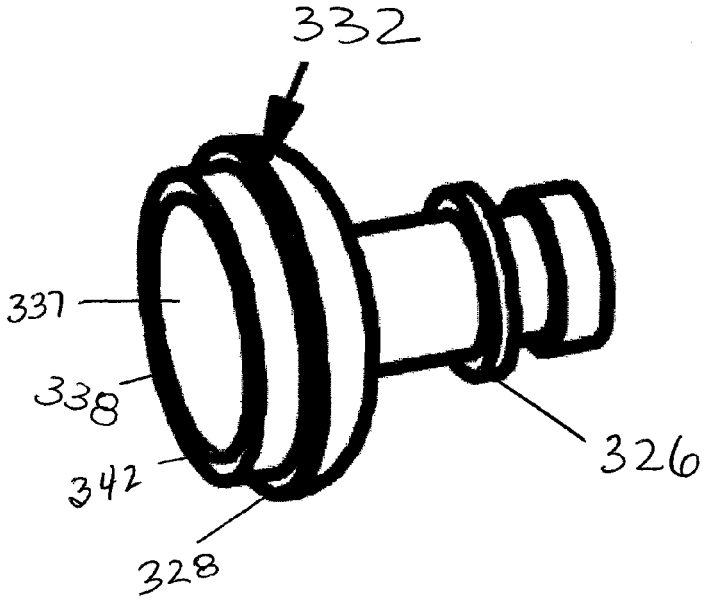
FIG. 23 is a perspective view of an embodiment of a portion of the housing of an earbud.

As depicted in FIGS. 22-23, transmitter section 332 includes stem 326 and speaker housing 328. FIG. 23 illustrates that transmitter section 332 including opening 337 to accommodate a transmitting device such as a speaker.

Figure 24:
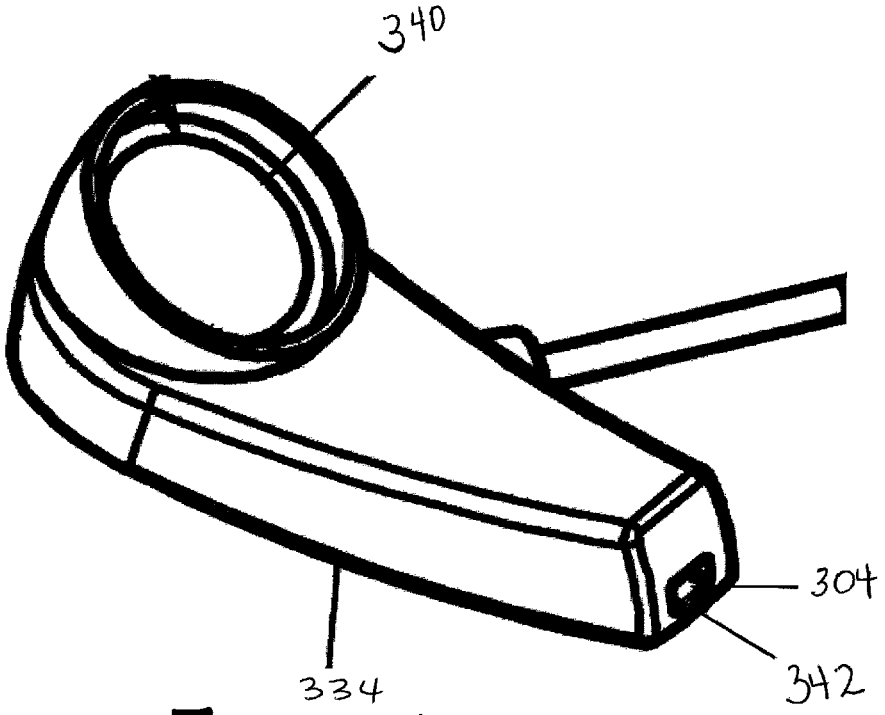
FIG. 24 is a perspective view of an embodiment of a portion of the housing of an earbud.
Figure 25:
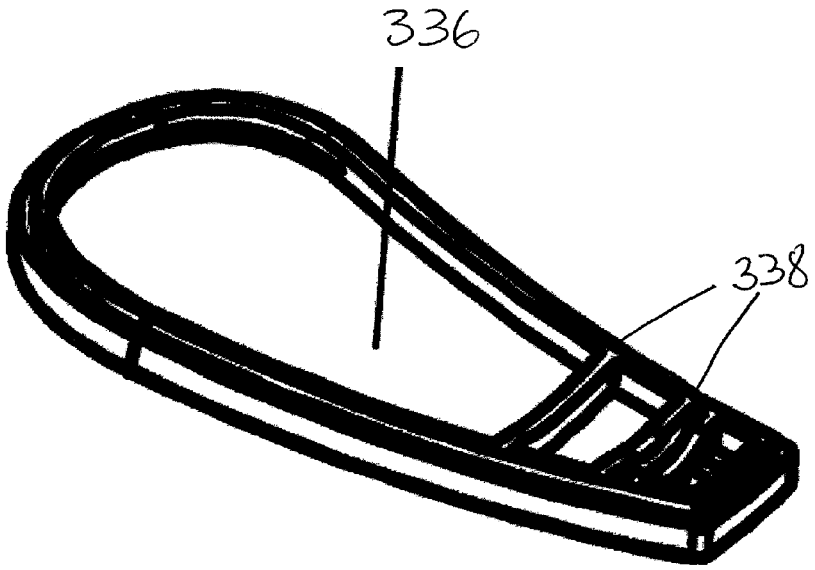
FIG. 25 is a perspective view of an embodiment of a portion of the housing of an earbud.
Figure 26:
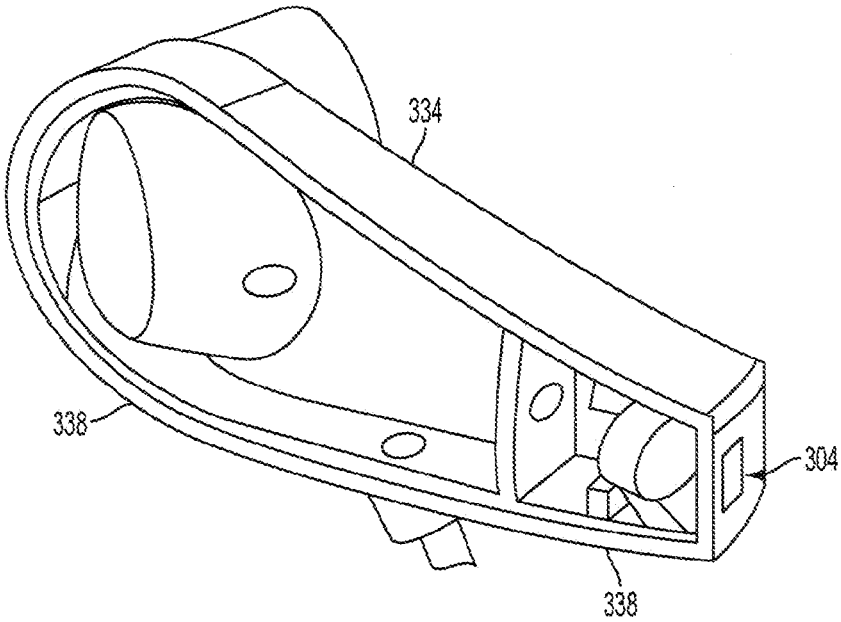
FIG. 26 is a perspective view of an embodiment of a portion of the housing of an earbud.
Figure 27:
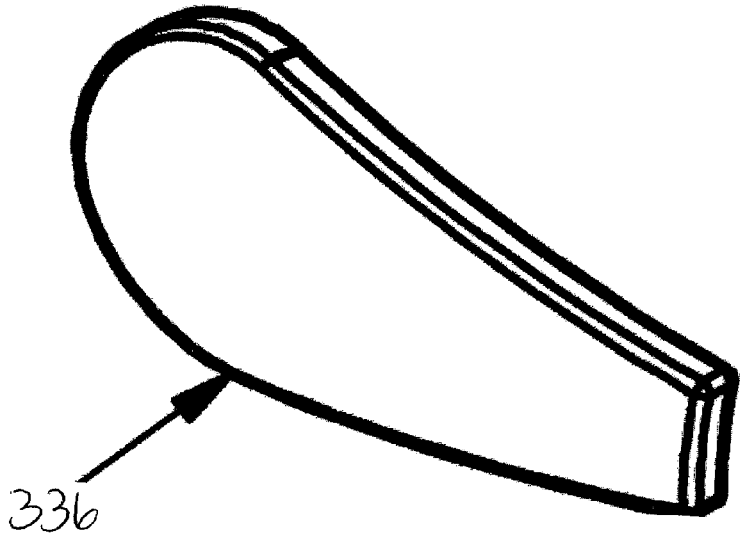
FIG. 27 is a perspective view of an embodiment of a portion of the housing of an earbud.

In some embodiments, acoustic insulation may be used to mechanically and/or acoustically isolate vibrations emanating from the speaker. Acoustic insulation may include structural features such as walls, fittings such as rubber fittings, grommets, glue, foam, materials known in the art and/or combinations thereof. As is depicted in FIGS. 24-26 portions of housing 314 include walls 338 to isolate speaker 340 from the housing and microphone element 304. Thus, microphone element 304 may primarily detect sound vibrations generated by the user rather than those generated by the speaker. In some embodiments, a backside of a speaker may be sealed with glue and/or foam.

As depicted in FIG. 24, inner section 334 is constructed to couple to transmitter section 332. Acoustic insulation may be utilized where the inner section is coupled to transmitter section, proximate the speaker, and/or proximate the microphone element. As shown in FIG. 24, insulating member 342 acoustically and vibration ally seals microphone element 303 from housing 314 and speaker 340.

Microphone element 304 may include, but is not limited to any type of microphone known in the art, receivers such as a carbon, electrets, pies crystal, etc. Microphone element 304 may be insulated from housing 314 by acoustic insulation. For example, insulating member 342 may be used to mechanically and acoustically isolate the microphone elements from any vibrations from the housing and/or speakers. Insulating members may be constructed from any material capable of insulating from sound and/or vibration including, but not limited to rubber, silicon, foam, glue, materials known in the art or combinations thereof. For example, in an embodiment an insulating member may be a gasket, rubber grommet o-ring, any designs known in the art and/or a combination thereof.

In some embodiments, earbud 303 includes connecting means 330 to couple earbuds to one or more devices. Embodiments of earbuds may also include wireless technologies which enable the earbuds to communicate with one or more devices, including but not limited to wireless transmitter/receiver, such as Bluetooth, or any other wireless technology known in the art.

Figure 28:
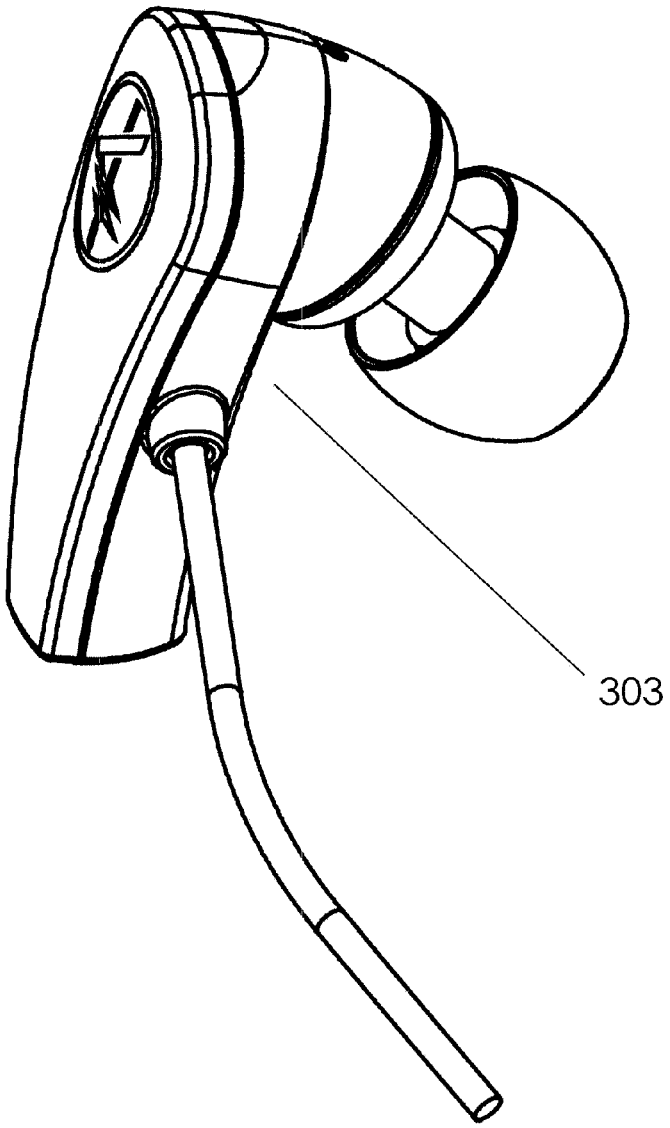
FIG. 28 is a photograph of a perspective view of an embodiment of an earbud.
Figure 29:
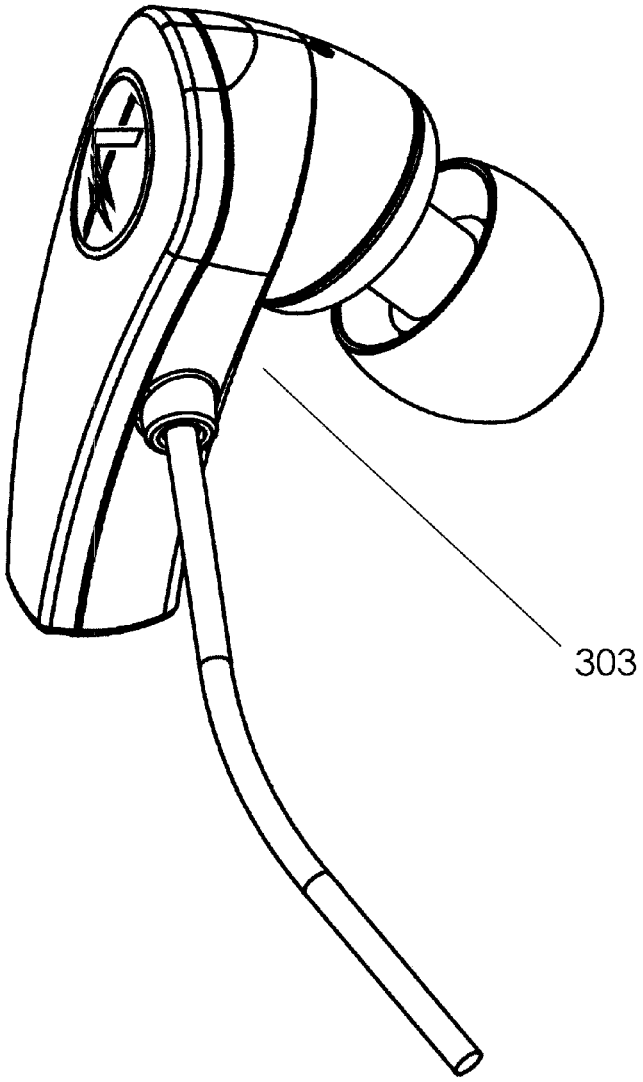
FIG. 29 is a photograph of a perspective view of an embodiment of an earbud.
Figure 30:
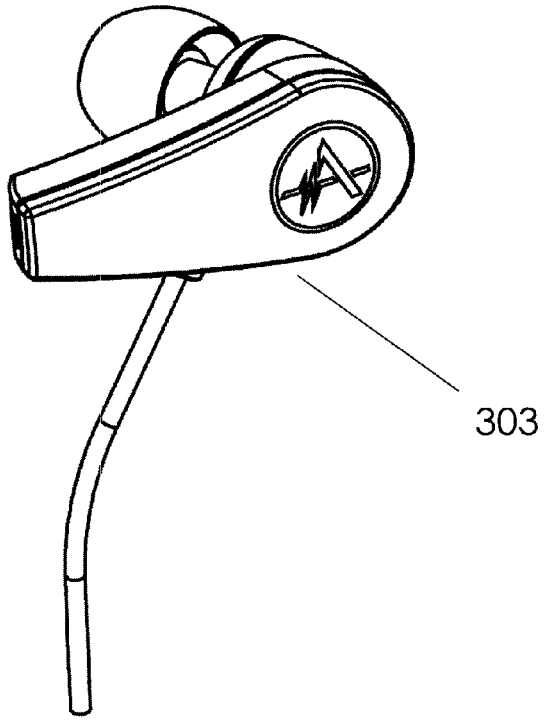
FIG. 30 is a photograph of a perspective view of an embodiment of an earbud.

In some embodiments as is shown in FIGS. 28-30, earbud 303 may be formed from one or more components and/or materials. For example, portions of the housing may be formed from a plastic and other portions of the housing may be formed from metal or the like.

The above described embodiments may be inexpensively deployed because most of today's PCs have integrated audio systems with stereo microphone input or utilize Bluetooth® or a USB external sound card device. Behind the microphone input connector may be an analog to digital converter (A/D Codec), which digitizes the left and right acoustic microphone signals. The digitized signals are then sent over the data bus and processed by the audio filter driver and algorithm by the integrated host processor. The algorithm used herein may be the same adaptive beam forming algorithm as described above. Once the noise component of the audio data is removed, clean audio/voice may then be sent to the preferred voice application for transmission.

This type of processing may be applied to a stereo array microphone system that may typically be placed on a PC monitor with distance of approximately 12-18 inches away from the user's the mouth. In the present invention, however, the same array system may be placed on the persons head to reduce the microphone sensitivity and points the two microphones in the direction of the person's mouth.

As noted above, in one embodiment, the audio transmitting/receiving device may be, for example, a pair of earbuds. In this embodiment, each earbud may include one or more audio receiving means (e.g., microphone(s)). Positioning audio receiving means on each earbud creates a dual-channel audio reception device that may be used to create desirable audio effects.

For example, this embodiment may be advantageously used to produce a surround sound effect. Such a surround sound effect is made possible by virtue of the audio receiving devices being positioned on each side a user's head during operation. While a user is wearing the earbuds, the audio receiving means on each earbud may pick up the same sound emanating from a single sound source (i.e., the respective audio receiving means may create a binaural recording). Because of the spatial discrepancy between each of the audio receiving means, a distinct audio signal may be produced in each of the channels corresponding to the same sound.

Each of these distinct audio signals may then be transmitted from the audio receiving means to the audio outputting means on the earbuds for playback. For example, the sound received by the audio receiving means on the left earbud may be converted to an audio signal in the left channel and transmitted to the audio outputting means on the left earbud for playback. Similarly, the sound received by the audio receiving means on the right earbud may be converted to an audio signal in the right channel and transmitted to the audio outputting means on the right earbud for playback. Because of the slight difference in each audio signal, a user wearing the dual-earbud device will be able to perceive the location from which the sound was originally produced during playback through the audio outputting means (e.g., speakers). For example, if the original sound was produced from a location to the left of the user, the audio output from the left earbuds audio outputting means would be greater in magnitude than the audio output from the right earbuds audio outputting means. In some embodiments, any audio transmitting/receiving device including a headset may function as described above to transmit and/or playback sound.

In various embodiments, the audio transmitting/receiving device also allows for the application of audio enhancement techniques, such as active noise reduction (ANR). For example, the dual-channel earbud embodiment allows for the application of audio enhancement techniques, such as active noise reduction (ANR). Active noise reduction refers to a technique for reducing unwanted sound. Generally, ANR works by employing one or more noise cancellation speakers that emit sound waves with the same amplitude but inverted phase with respect to the original sound. The waves combine to form a new wave in a process called interference and effectively cancel each other out. Depending on the design of the device/system implementing the ANR, the resulting sound wave (i.e., the combination of the original sound wave and its inverse) may be so faint as to be inaudible to human ears.

The system of the present disclosure provides for improved ANR due to the location of the audio receiving means in relation to a user's ears. Specifically, because the objective of ANR is to minimize unwanted sound perceived by the user, the most advantageous placement of each audio receiving means is at a location where the audio receiving means most closely approximate the sound perceived by the user. The audio transmitting/receiving device of the present disclosure achieves this approximation by incorporating audio receiving means into each body (i.e., earbud) of the device. Accordingly, each audio receiving means is located mere centimeters from a user's ear canal while the device is being used. In some embodiments, the audio receiving means may be mounted directly on the speaker housing as is depicted in FIG. 21.

In operation, the system of the present disclosure achieves ANR in the following manner. A sound is picked up by the audio receiving means on each earbud, converted into audio signals, and transmitted to an external device, such as a computing device, for processing. The processor of the computing device may then execute executable instructions causing the processor to generate an audio signal corresponding to a sound wave having an inverted phase with respect to the original sound, using ANR processing techniques known to one of ordinary skill in the art. For example, one known ANR processing technique involves the application of Andrea Electronics' Pure Audio® noise reduction algorithm. The generated audio signal may then be transmitted from the external device to the audio outputting means of the earbuds for playback. Due to the rapidity in which the processing takes place, the original sound wave and its inverse may combine to effectively cancel one another out, thereby eliminating the unwanted sound. A user may activate ANR by, for example, selecting an ANR (a.k.a., noise cancellation, active noise control, antinomies) option on a GUI, such as the GUI shown in FIG. 11, that is displayed on an integrated or discrete display of the computing device. It is recognized that the computing device may comprise any suitable computing device capable of performing the above-described functionality including, but not limited to, a personal computer (e.g., a desktop or laptop computer), a personal digital assistant (PDA), a cell phone, a Smartphone (e.g., a blackberry®, phone®, Droid®, etc.), an audio playing device (e.g., an iPod®, MP3 player, etc.), image capturing device (e.g., camera, video camera, digital video recorder), sound capturing device etc.

In some embodiments, the audio transmitting/receiving device allows for the application of other audio enhancement techniques. For example, the earbud embodiment of the present disclosure advantageously allows for the application of other audio enhancement techniques besides ANR, as well. For example, the beamforming algorithm illustrated in FIG. 1, or any other suitable beamforming algorithm known in the art, may be applied using the earbuds disclosed herein. In one example, the earbuds may provide for broadside beamforming using broadside beamforming techniques known in the art. In operation, beamforming may be applied in a manner similar to the application of ANR. That is, the sound picked up by the audio receiving means on the earbuds may be converted to audio signals that are transmitted to an external device comprising a processor for processing. The processor may execute executable instructions causing it to generate an audio signal that substantially fails to reflect noise generated from an area outside of the beam width.

Figure 11:
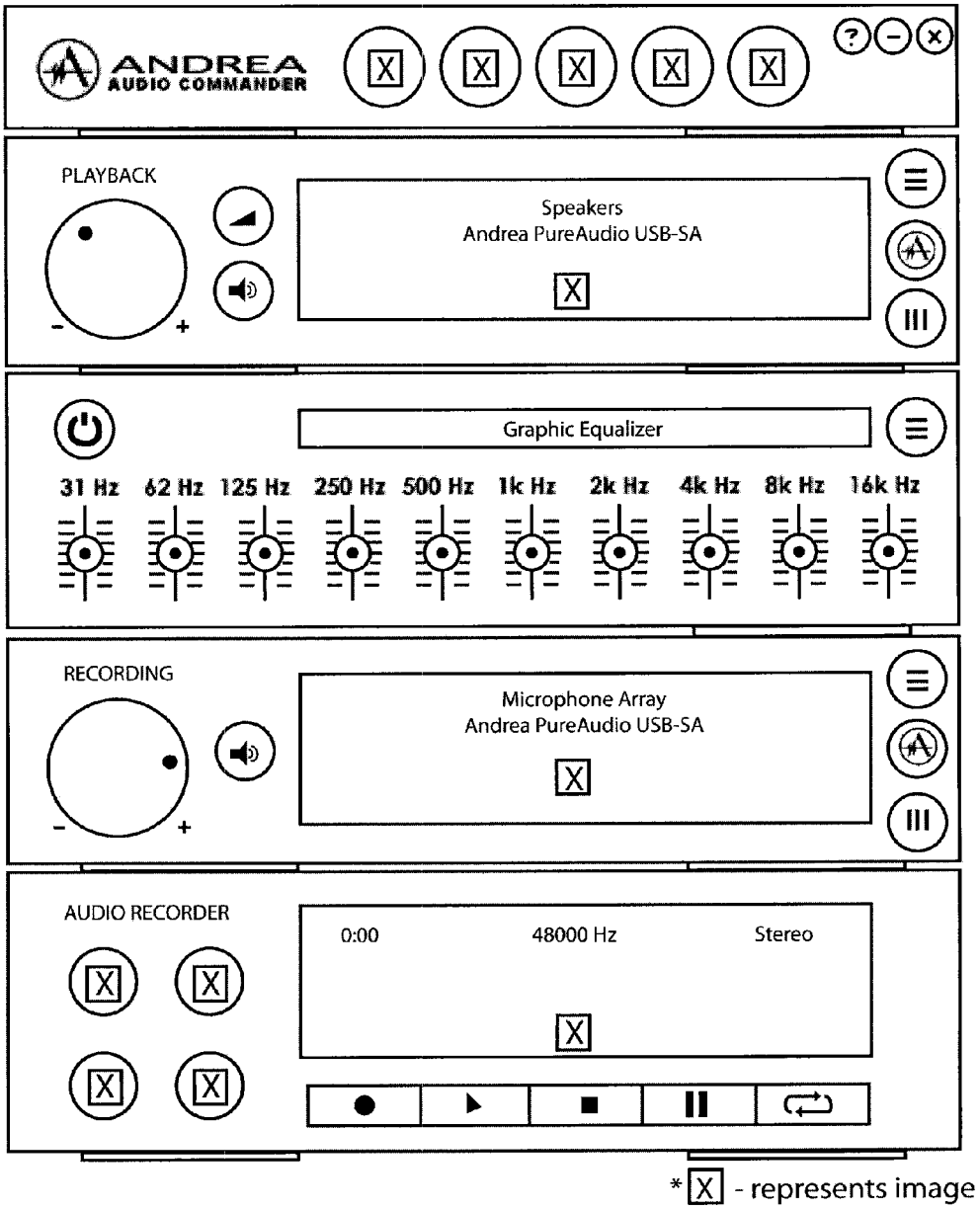
FIG. 11 is a depiction of an example of a visual interface that can be used in accordance with the present invention.

A user may apply a beamforming algorithm by, for example, selecting a beamforming option on a GUI, such as the GUI shown in FIG. 11. When beamforming is applied to received audio signals, the output audio signals will contain substantially less background noise (i.e., less noise corresponding to noise sources located outside of the beam). Furthermore, the direction of a beam may also be modified by a user. For example, a user may modify the direction of the beam by moving a slider on a "Beam Direction" bar of a GUI, such as the GUI shown in FIG. 11. The application of beamforming techniques on the audio signals received by the audio receiving means of the present disclosure may substantially enhance a user's experience in certain settings. For example, the above-described technique is especially suitable when a user is communicating using a Voice Over Internet Protocol (VoIP), such as Skype® or the like.

Furthermore, the earbud and/or headphone embodiment of the present disclosure may be advantageously used as a directional listening device. In this example, the beamforming techniques described above may be applied to hone the beam on a sound source of interest (e.g., a person). The sound emanating from the sound source of interest may be received by the audio receiving means on the earbuds, converted to audio signals, and transmitted to an external device comprising a processor for processing. In addition to applying beamforming, in this example, the processor may additionally execute executable instructions causing it to amplify the received signals using techniques well-known in the art. The amplified signals may then be transmitted to the audio outputting means on the earbuds where a user wearing the earbuds will perceive an amplified and clarified playback of the original sound produced by the sound source of interest.

Any of the methods described may be used with an audio transmitting/receiving device such as, but not limited to, one or more earbuds and/or headphones.

Figure 31:
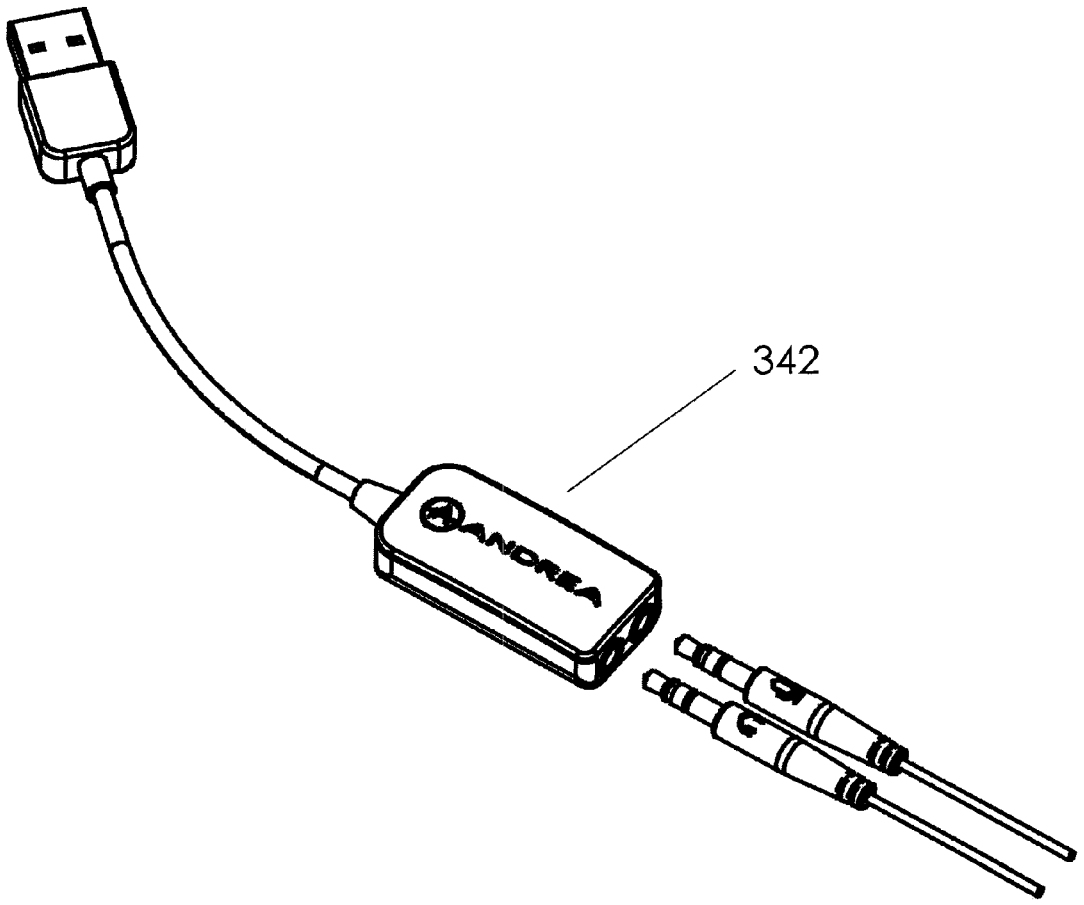
FIG. 31 is a photograph of an embodiment of an audio transmitting/receiving device connected to an external device.

As shown in FIG. 31, in some embodiments, an audio transmitting/receiving device, such as a set of earbuds 303 is connected to an external device, such as adaptor 342. In various embodiments, an external device such as an adaptor may include a processor and memory containing executable instructions that when executed by the processor cause the processor to apply one or more audio enhancement algorithms to received audio signals. For example, the memory may contain executable instructions that when executed cause the processor to apply one or more active noise reduction algorithm(s), beamforming algorithm(s), directional listening algorithm(s), and/or any other suitable audio enhancement algorithms known in the art. In an embodiment where the external device comprises an adaptor, the adaptor may facilitate the connection of the audio transmitting/receiving device to one or more additional external device(s), such as any suitable device capable of utilizing sound including, but not limited to, a personal computer (e.g., a desktop or laptop computer), a personal digital assistant (PDA), a cell phone, a Smartphone (e.g., a blackberry®, phone®, Droid®, etc.), an audio playing device (e.g., an iPod®, MP3 player, television etc.), image capturing device (e.g., camera, video camera, digital video recorder), sound capturing device (e.g., hearing aid), gaming console, etc. Providing a standalone adaptor capable of applying various sound enhancement techniques when used in conjunction with the audio transmitting/receiving device provides for increased compatibility and portability. That is, the present disclosure allows a user to travel with their audio transmitting/receiving device and corresponding adaptor and transmit enhanced (i.e., manipulated) audio signals to any additional external device that is compatible with the adaptor.

In another embodiment, the adaptor does not include any processing logic or memory containing executable instructions. In this embodiment, the adaptor still provides substantial utility. For example, third parties may be able to apply audio enhancement techniques (e.g., beamforming algorithms or the like) to an audio signal transmitted from the audio transmitting/receiving device through an adaptor. In this embodiment, the adaptor merely functions to ensure that the audio signals received by the audio receiving means of the audio transmitting/receiving device may be properly transferred to another external device (i.e., the adaptor provides for compatibility between, e.g., the earphones and another external device such as a computer). For example, a user may wish to use the disclosed audio transmitting/receiving device to communicate with someone using voice over the internet protocol (VoIP). However, it is possible that the internet enabled television that the user wants to use to facilitate the communication is incompatible with the audio transmitting/receiving device's input. In this situation, the user may connect their audio transmitting/receiving device to an adaptor-type external device, which in turn may be connected to the internet enabled TV providing the necessary compatibility. In this type of embodiment, it is further appreciated that a VoIP provider (e.g., Skype®) could apply one or more audio enhancement algorithms on the received audio signal. For example, the audio signal may travel from the audio transmitting/receiving device through the adaptor, through the internet enabled TV, to the VoIP provider's server computer where different audio enhancement algorithms may be applied before routing the enhanced signal to the intended recipient.

Figure 32:
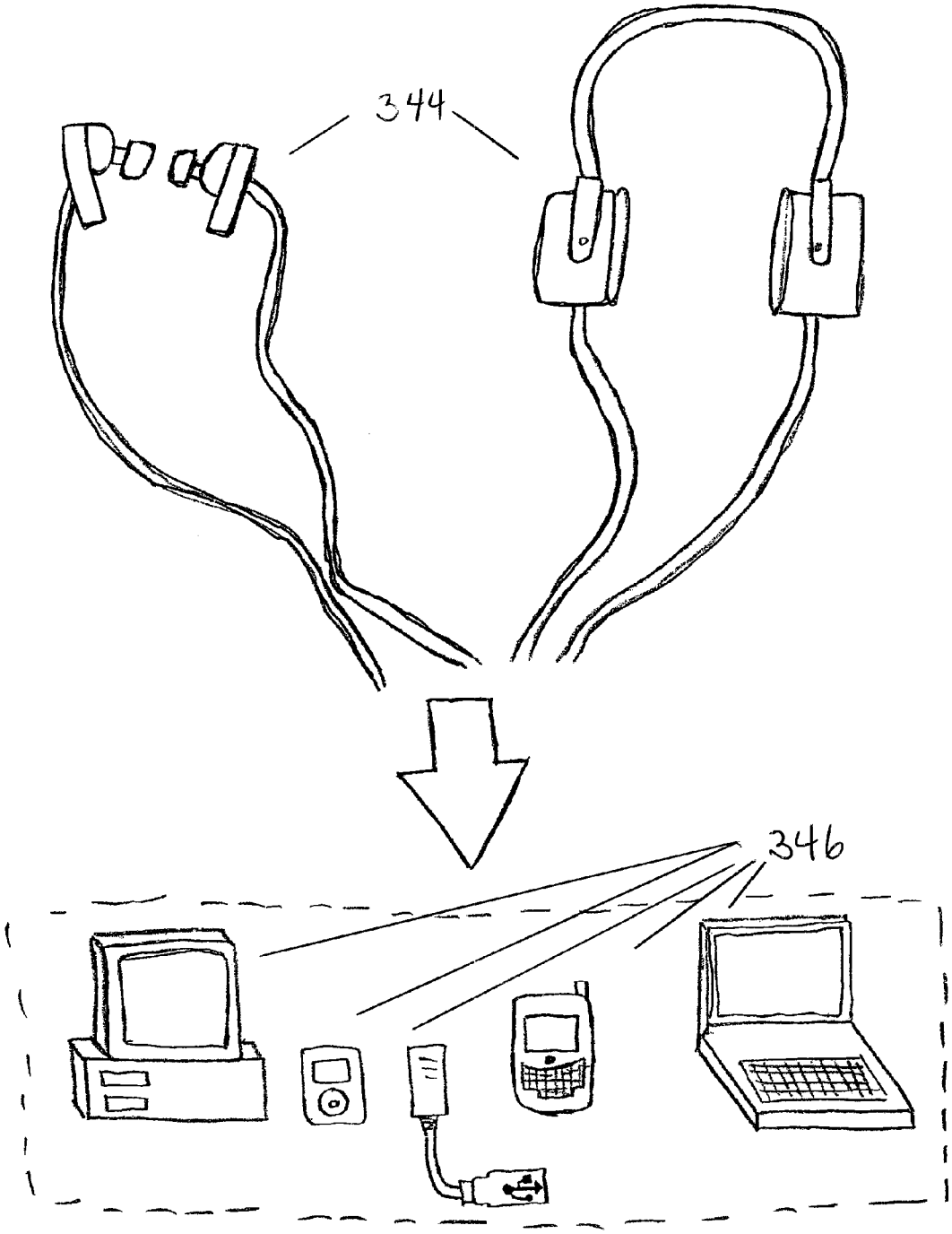
FIG. 32 is an illustration of an embodiment of audio transmitting/receiving devices connected to external devices.
Figure 33:
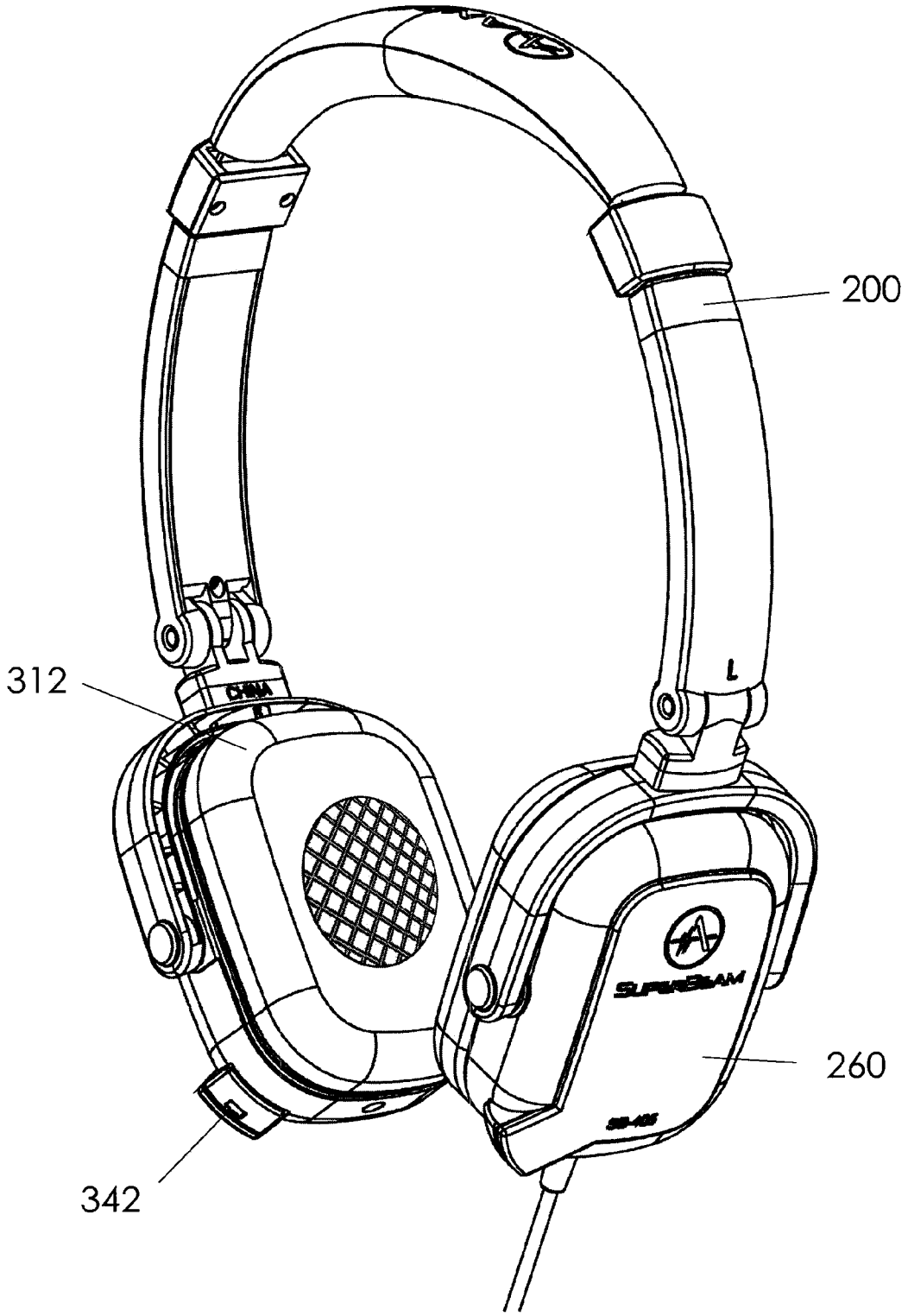
FIG. 33 is a photograph of an embodiment of an audio transmitting/receiving device.

As is illustrated in FIG. 32, audio transmitting/receiving devices 344 may be connected to a variety of external devices 346 as are described above.

The figures used herein are purely exemplary and are strictly provided to enable a better understanding of the invention. Accordingly, the present invention is not confined only to product designs illustrated therein.

Thus by the present invention its objects and advantages are realized and although preferred embodiments have been disclosed and described in detail herein, its scope should not be limited thereby rather its scope should be determined by that of the appended claims.

What is claimed is:

1. An audio headset system for manipulating audio signals, comprising:

the audio headset, comprising:

a first housing and a second housing separated by a predetermined distance, wherein the first housing and the second housing are operatively connected;

a first sound sensor in the first housing;

a first audio speaker in the first housing, the first audio speaker in close proximity to and acoustically isolated from the first sound sensor;

a second sound sensor in the second housing;

a second audio speaker in the second housing, the second audio speaker in close proximity to and acoustically isolated from the second sound sensor; and a signal processing control unit operatively connected to the first sound sensor and to the second sound sensor for collecting audio signals corresponding to sound sensed by each of the first sound sensor and the second sound sensor, the signal processing control unit configured to apply a beamforming algorithm to the collected audio signals, and to selectively transmit the beamformed collected audio signals;

wherein the signal processing control unit is further configured to capture, amplify and transmit audio signals received by the first sound sensor and the second sound sensor when the audio signals received by the first sound sensor and the second sound sensor are in-phase with one another and for selectively canceling audio signals received by the first sound sensor and the second sound sensor when the audio signals received by the first sound sensor and the second sound sensor are out-of-phase with one another.

2. The audio headset system of claim 1, wherein the signal processing control unit comprises a sound card, an adaptor, an audio card, a dongle, a communications device, a recording device, a computing device or a combination thereof.

3. The audio headset system of claim 1, wherein the first sound sensor and the second sound sensor each comprises at least one microphone.

4. The audio headset system of claim 1, wherein the beamforming algorithm comprises a broadside beamforming algorithm.

5. The audio headset system of claim 4, wherein the signal processing control unit comprises a processing means operative to execute executable instructions causing the signal processing control unit to:

in response to receiving first and second audio signals from the first sound sensor and the second sound sensor, apply the broadside beamforming algorithm to the received first and second audio signals to provide a broadside beamformed audio signal, amplify the broadside beamformed audio signal, and transmit the amplified broadside beamformed audio signal.

6. The audio headset system of claim 1, wherein the signal processing control unit is further configured to collect ambient sound from the first sound sensor and the second sound sensor and to apply active noise reduction in response to said ambient sound to produce an anti-noise signal and to deliver said anti-noise signal selectively to the first audio speaker and the second audio speaker.

7. The audio headset system of claim 6, wherein said active noise reduction includes receiving signals representing said ambient sound and inverting said signals representing said ambient sound to produce inverted ambient signals, amplifying said inverted ambient signals to produce amplified and inverted ambient signals and selectively delivering said amplified and inverted ambient signals to the first audio speaker and the second audio speaker.

8. The audio headset system of claim 1, wherein the signal processing control unit comprises a processing means operative to execute executable instructions causing the processing means to:

in response to receiving first and second audio signals from the first sound sensor and the second sound sensors, apply the beamforming algorithm to the received first and second audio signals to provide a beamformed audio signal, amplify the beamformed audio signal, and transmit the amplified beamformed audio signal.

9. A method of manipulating audio signals in an audio headset, the audio headset comprising a first sound sensor in a first housing, a first audio speaker in the first housing, the first audio speaker in close proximity to and acoustically isolated from the first sound sensor and a second sound sensor in a second housing, a second audio speaker in the second housing, the second audio speaker in close proximity to and acoustically isolated from the second sound sensor, the first and second housings separated by a predetermined distance and operatively connected to one another, the method comprising:

collecting audio signals from the first sound sensor of the audio headset and the second sound sensor of the audio headset;

applying a beamforming algorithm to the collected audio signals to produce a beamformed audio signals;

selectively transmitting the beamformed audio signal;

capturing audio signals received by the first sound sensor and the second sound sensor when the captured audio signals are in-phase with one another to produce captured in-phase signals and reducing audio signals received by the first sound sensor and the second sound sensor when the captured audio signals are out-of-phase with one another;

amplifying said captured in-phase signals to produce amplified and captured in-phase signals; and selectively transmitting said amplified and captured in-phase signals.

10. The method of claim 9, wherein the first sound sensor and the second sound sensor comprise at least one microphone.

11. The method of claim 10, further comprising applying an active noise reduction (ANR) signal process to the collected audio signals.

12. The method of claim 10, further comprising amplifying the beamformed audio signals before selectively transmitting the beamformed audio.

13. The method of claim 9, wherein applying a beamforming algorithm comprises applying a broadside beamforming algorithm.

14. The method of claim 13, further comprising:

collecting ambient sound from the first sound sensor and the second sound sensor;

applying active noise reduction in response to said ambient sound to produce anti-noise; and delivering said anti-noise selectively to the first audio speaker and the second audio speaker.

15. The method of claim 14, wherein said active noise reduction includes receiving signals representing said ambient sound and inverting said signals representing said ambient sound to produce inverted ambient signals, amplifying said inverted ambient signals to produce amplified and inverted ambient signals and selectively delivering said amplified and inverted ambient signals to the first audio speaker and the second audio speaker.

16. The method of claim 9, further comprising:

capturing audio signals received by the first sound sensor to produce first captured audio signals;

amplifying said captured audio signals from the first sound sensor to produce first amplified and captured audio signals;

transmitting said first amplified and captured audio signals from the first sound sensor to the first audio speaker;

capturing audio signals received by the second sound sensor to produce second captured audio signals;

amplifying said second captured audio signals from the second sound sensor to produce second amplified and captured audio signals; and transmitting said second amplified and captured audio signals from the second sound sensor to the second audio speaker.

* * * * *